US012350565B1

(12) United States Patent
Wen

(10) Patent No.: US 12,350,565 B1
(45) Date of Patent: Jul. 8, 2025

(54) SOCCER BALL AND SOCCER TRAINING ASSEMBLY

(71) Applicant: Zizheng Wen, Shenzhen (CN)

(72) Inventor: Zizheng Wen, Shenzhen (CN)

( * ) Notice: Subject to any disclaimer, the term of this patent is extended or adjusted under 35 U.S.C. 154(b) by 0 days.

(21) Appl. No.: 18/829,400

(22) Filed: Sep. 10, 2024

(30) Foreign Application Priority Data

Jan. 4, 2024 (CN) ..... 202410016224.5

(51) Int. Cl.
*A63B 69/00* (2006.01)
*A63B 43/00* (2006.01)

(52) U.S. Cl.
CPC ..... *A63B 69/002* (2013.01); *A63B 43/008* (2013.01); *A63B 2243/0025* (2013.01)

(58) Field of Classification Search
CPC ..... A63B 43/008
USPC ..... 473/446
See application file for complete search history.

(56) References Cited

U.S. PATENT DOCUMENTS 5,947,845 A * 9/1999 Canelas ..... A43B 5/02 473/446
7,172,521 B1 * 2/2007 Novis ..... A63B 69/002 473/422
7,241,234 B2 * 7/2007 Eite ..... A63B 69/002 473/422
2003/0228942 A1 * 12/2003 Hsieh ..... A63B 71/06 473/446
2005/0119071 A1 * 6/2005 Carbonero ..... A63B 41/08 473/464
2008/0076610 A1 * 3/2008 Torres ..... A63B 41/00 473/604
2008/0293520 A1 * 11/2008 Brown ..... A63B 43/008 473/604
2018/0015334 A1 * 1/2018 Solotoff ..... A63B 43/008 473/446
2019/0070466 A1 * 3/2019 Comeau, III ..... A63B 69/002 473/446

* cited by examiner

*Primary Examiner* — Mitra Aryanpour
(74) *Attorney, Agent, or Firm* — Bayramoglu Law Offices LLC

(57) ABSTRACT

Provided are soccer ball and soccer training assembly. The soccer ball has sphere and marking area arranged on outer surface of sphere. The marking area includes initial-targeting guide line, ball-placing line, and hitting-point set respectively arranged on the outer surface of sphere. The initial-targeting guide line and the ball-placing line lie in diverse sections, each of which is sectional plane passing through the center of sphere. The hitting-point set includes multiple spaced hitting-datum points arranged on route defining section coinciding with the section which the initial-targeting guide line lies in. A defined horizontal midline section is as another sectional plane passing through the center of sphere, which is parallel to the ground when the section which the initial-targeting guide line lies in and the section which the ball-placing line lies in are both perpendicular to the ground. The multiple hitting-datum points are arranged downwards from the horizontal midline section.

20 Claims, 8 Drawing Sheets

SOCCER BALL AND SOCCER TRAINING ASSEMBLY

CROSS REFERENCE TO RELATED APPLICATIONS

The present application claims priority to Chinese Patent Application No. CN2024100162245, filed on Jan. 4, 2024, named "a soccer ball and a soccer training assembly", the entire disclosure of which is incorporated herein by reference in its entirety.

FIELD OF THE INVENTION

The present invention relates to the technical field of sports equipment, specifically, to a soccer ball and a soccer training assembly.

BACKGROUND OF THE INVENTION

In soccer, a place kick is an important and advanced skill, including a free kick, a penalty kicks, a corner kick, a goal kick and the likes. Each of these kicks includes stages such as placing a ball and aiming, approaching the ball, landing a supporting foot, striking the ball and following through to send the foot, and in these stages, there are strict and diverse requirements for objective technical elements such as a specific angle, a distance, a position and a direction. It is necessary for soccer players to understand the influence of the above objective technical elements on the effect of striking the ball by way of trialing a lot and form action habits and muscle memory by way of practicing a lot, so as to habituate an action and master a specific type of place-kick skills. However, in the related technology, there is shortage of training apparatuses used to practice the place kick, which are capable of systematically, perfectly, accurately, rigorously and efficiently directing objective technical elements such as a specific angle, a distance, a position and a direction in each action stage, so it is difficult for soccer players to make the above elements accord with "keeping the most precise and stable" for precise trails and correct repetitious practices on the action, resulting low training efficiency and poor training effect.

SUMMARY OF THE INVENTION

The present invention provides a soccer ball, a soccer training assembly and a training device that are capable of enhancing efficiency and effect for practicing place kicks.

The present invention embodies the following aspects.

An example according to the present invention provides a soccer ball, which has a sphere and a marking area arranged on an outer surface of the sphere. The marking area includes an initial-targeting guide line, a ball-placing line, and a hitting-point set that are respectively arranged on the outer surface of the sphere. The initial-targeting guide line and the ball-placing line lie in diverse sections, each of which is a sectional plane passing through the center of the sphere. The hitting-point set includes a plurality of spaced hitting-datum points, which are arranged on a route defining a section coinciding with the section which the initial-targeting guide line lies in. A defined horizontal midline section is as another sectional plane passing through the center of the sphere, which is parallel to the ground when the section which the initial-targeting guide line lies in and the section which the ball-placing line lies in are both perpendicular to the ground.

The plurality of hitting-datum points are arranged downwards from the horizontal midline section.

In the above example, arrangement routes such as an initial-targeting guide line, a ball-placing line, and a hitting-datum point are circumferential lines formed by intersecting a sectional plane passing through the center of the sphere with the spherical surface of the sphere. After the ball rotating with respect to a user, the lines that lie in the relevant sections in the marking area can be visually overlapped with each other to form a straight line when the use stands right transversally facing these sections. According to the intersection angle relation between the initial-targeting guide line and the ball-placing line with respect to the ground, after the user has rotated the ball in place, when the section which the initial-targeting guide line lies in is perpendicular to the ground, the initial-targeting guide line will be presented as being "perpendicular" to the ground in user's sight; when the section which the ball-placing line lies in is perpendicular to the ground, the ball-placing line will be presented as being "perpendicular" to the ground in user's sight. In addition, when the user stands right transversally facing the section which the initial-targeting guide line lies in and "perpendicular" to the ground, the initial-targeting guide line can be presented as a "straight line" in user's sight, so as to make it possible to indicate the direction. Therefore, it is possible to determine the position of the marking area on the sphere relative to the ground and a kick target, so as to complete "correctly placing the ball", improve the efficiency of placing the ball, and thus enhance training efficiency, by way of placing the ball to enable the sections which the initial-targeting guide line and the ball-placing ball line lie in to be perpendicular to the ground, and the initial-targeting guide line to be directed to a preset target. A plurality of hitting-datum points are located on the section which the initial-targeting guide line lies in, thus it is possible for the user to determine the flight direction of the ball when the user strikes the ball by means of the hitting-datum points by way of directing the "straight line" presented by the initial-targeting guide line to the preset target. After "correctly placing the ball", each hitting-datum point is arranged downwards from the horizontal midline section; thus, the user kicks the ball in the light of the position indicated by each hitting-datum point, so that the ball flies out in the direction indicated by the initial-targeting guide line. In addition, the farther the user's kick at the ball from the horizontal midline section, that is, the lower the hitting-datum points, the higher the ball is kicked out at an angle, so that the user can kick the ball at a corresponding hitting-datum point in the light of the angle corresponding to a height of a kicking to be practiced. It is possible for the user to quickly straighten the ball and quickly direct the foot to a struck target with aid of the initial-targeting guide line and the ball-placing line at the time of training with the soccer ball disclosed by the present invention for practicing a place kick, then quickly completing the "correctly placing the ball", so that the position of each hitting-datum point with respect to the ground, the sphere and the preset struck target are correctly determined, while ensuring that flight directions and trajectories of the ball will keep identical with each other and determined after lots of kicks by way of approaching the ball and striking the ball. In this way, the user can judge whether he has accurately and effectively struck a desired hitting point on the sphere through his full set of striking actions in the light of a ball kicking effect after striking the ball, so as to improve and habituate the elements in the actions, such as a ball-approaching angle and route, a landing supporting foot, a striking posture and a follow-through; thus, the user can form action habits and muscle memory after being familiar with effective actions, so that in the case of kicking a soccer ball that does not have a marking area, the user can also apply the details of the actions skillfully mastered to stably make a ball-kick having a specific effect obtained during training. Therefore, it is possible to improve the training efficiency and effectiveness of practicing a place kick by way of using the soccer ball with the above-mentioned marking area to execute a soccer practice.

Preferably, a defined central axis is as an intersecting line between the section which the initial-targeting guide line lies in and the section which the ball-placing line lies in, the marking area further includes a ball-approaching guide mark, the ball-approaching guide mark has a plurality of ball-approaching angle points, intersection angles between sections which the diverse ball-approaching angle points and the central axis lie in and the section which the initial-targeting guide line lies in are different from each other.

In the above example, when a user takes a place kick, the user approaches a ball in different directions relative to the ball, thus influencing elements such as a direction of the force applied from a user's kicking-foot at the time of kicking the ball. Each ball-approaching angle point and a central axis lie in a section, which forms an intersecting angle with the section which the initial-targeting guide line lies in, making it possible to indicate a ball-approaching angle to the user. After "correctly placing the ball", the user stands right transversally facing the section which the ball-approaching angle point and the central axis lie in, the initial-targeting guide line may be visually presented as a "straight line", which can be used to indicate an intersection angle for approaching the ball relative to a direction of kicking the ball, to the user, in this way, it is convenient for the user to repeat training in different ball-approaching directions, and enhance training efficiency and training effect.

Preferably, the ball-approaching guide mark further includes a plurality of ball-approaching guide lines, each the ball-approaching angle point is set on a respective the ball-approaching guide line; when the section which the initial-targeting guide line lies in and the section which the ball-placing line lies in are both perpendicular to the ground, a section which each the ball-approaching guide line lies in is perpendicular to the ground.

In the above example, a section which a ball-approaching guide line lies in is the section which the ball-approaching angle point and the central axis lie in; after "correctly placing the ball", a user stands right transversally facing "the section which the ball-approaching guide line lies in" corresponding to the ball-approaching point to be practiced; the ball-approaching guide line will be presented as a "straight line" in user's sight, which can be used to indicate a direction, improving the user's recognition for a ball-approaching direction, and helping to enhance training efficiency and training effect of training the user for a ball-approaching direction.

Preferably, the defined central axis is as an intersecting line between the section which the initial-targeting guide line lies in and the section which the ball-placing line lies in, the marking area further includes a follow-through guide mark, and the follow-through guide mark includes a plurality of follow-through angle points; intersection angles between sections which the diverse follow-through angle points and the central axis lie in and the section which the initial-targeting guide line lies in are different from each other.

In the above example, when the user takes a place kick, taking a follow-through action in different directions with respect to the soccer ball will influence the direction of the force applied by the user's foot at the time of kicking the ball.

Preferably, the follow-through guide mark further includes a plurality of follow-through guide lines, and each the follow-through angle point is set at a respective the follow-through guide line; when the section which the initial-targeting guide line lies in and the section which the ball-placing line lies in are both perpendicular to the ground, a section which each the follow-through guide line lies in is perpendicular to the ground.

In the above example, the section which the follow-through guide line lies in is the section which the follow-through angle point and the central axis lie in; after "correctly placing the ball", a user stands right transversally facing the section which the follow-through guide line corresponding to the follow-through angle to be practiced; the follow-through guide line will be presented as a "straight line" in user's sight, which can be used to indicate a direction, improving the user's recognition for a follow-through direction, and helping to enhance training efficiency and training effect of training the user for a follow-through direction.

Preferably, the hitting-point set further includes a first sidespin point; in a direction perpendicular to the section which the initial-targeting guide line lies in, the first sidespin point is spaced with one of the hitting-datum points.

In the above example, when a user takes a place kick, he applies sidespin to the ball by way of applying a force passing through a side of the sphere center on a side of a target striking position. After "correctly placing the ball", the user may regard the horizontal midline section as the "equator" position of the sphere, thus a first sidespin point and a hitting-datum point corresponding to it lie at a "parallel" position near the "equator" position; in this way, after "correctly placing the ball", the first sidespin point lies on a side of the hitting-datum point corresponding to it, so the user kicks the ball towards the first sidespin point, so as to make it possible to apply sidespin to the ball in the same direction as kicking towards the hitting-datum point corresponding to the first sidespin point; as a result, the user can repeat a sidespin practice, improving training efficiency and training effect.

Preferably, the hitting-point set includes a topspin point, which is spaced with the hitting-datum point, the topspin point lies in the section which the plurality of hitting-datum points lie in; when the section which the initial-targeting guide line lies in and the section which the ball-placing line lies in are both perpendicular to the ground, the topspin point lies below one of the hitting-datum points.

In the above example, when a user takes a place kick, he applies topspin to the ball by way of applying a force passing through a portion above the sphere center on a portion below a striking position at a target height. After "correctly placing the ball", a topspin point lies below a hitting-datum point corresponding to it, so the user kicks the ball towards the topspin point, so as to make it possible to apply topspin to the ball in the same direction as kicking towards the hitting-datum point corresponding to the topspin point; as a result, the user can repeat a topspin practice, improving training efficiency and training effect.

Preferably, the hitting-point set further includes a second sidespin point; in a direction perpendicular to the section which the initial-targeting guide line lies in, the second sidespin point is spaced with the topspin point.

In the above example, when a user takes a place kick, he applies sidespin to the ball by way of applying a force passing through a side of the sphere center on a side of a target striking position. After "correctly placing the ball", the user may regard the horizontal midline section as the "equator" position of the sphere, thus a second sidespin point and a topspin point corresponding to it lie at a "parallel" position near the "equator" position; in this way, after "correctly placing the ball", the second sidespin point lies on a side of the topspin point corresponding to it, so the user kicks the ball towards the second sidespin point, so as to make it possible to apply side-top-spin (diagonal topspin, 45° ball-rotation) to the ball with respect to the topspin point; as a result, the user can repeat a sidespin practice, improving training efficiency and training effect.

Preferably, the marking area further includes an assisting guide mark, which includes a mark-assisting hitting line and a mark-assisting hitting datum point, the mark-assisting hitting datum point lies at an intersection at which the mark-assisting hitting line is intersected with the horizontal midline section; when the section which the initial-targeting guide line lies in and the section which the ball-placing line lies in are both perpendicular to the ground, the section which the mark-assisting hitting line lies in is perpendicular to the ground.

In the above example, after "correctly placing the ball", a section which a mark-assisting hitting line lies in is also perpendicular to the ground, and the mark-assisting hitting line can also be presented as a "straight line" in user's sight, so as to point to the direction of striking a target ball; in this way, the user can draw a point or a line near the undermentioned base point according to needs as a new hitting point by way of taking the mark-assisting hitting line and the intersection at which the mark-assisting hitting line is intersected with the horizontal midline section, that is, a mark-assisting hitting datum point as a reference, so as to study and trial a new striking effect.

Preferably, a completely-blank area exists near the intersection, and the completely-blank area lies apart from the mark-assisting hitting line.

In the above example, setting a completely blank area to facilitate coloring it with an oily marker makes it possible for a user to add supplementary marks such as a hitting-point set, a ball-approaching guide mark, or a follow-through guide mark for various desired effect in the completely blank area, helping to improve training effect.

Preferably, a defined central axis is as an intersecting line between the section which the initial-targeting guide line lies in and the section which the ball-placing line lies in, and the marking area further includes a first ball-placing point and a second ball-placing point; the first ball-placing point and the second ball-placing point respectively lie on both ends of the central axis.

In the above example, after "correctly placing the ball", one of a first ball-placing point and a second ball-placing point should lie at the top of the sphere, and the other should lie at the bottom of the sphere; thus a user can assist in adjusting the placement posture of the sphere with aid of a position of the first ball-placing point and the second ball-placing point relative to the ground, so as to improve the accuracy and efficiency for placing the sphere, making it possible for a left-footed/right-footed player to use most of the marks on the outer surface of the sphere (except for a hitting-point set/penalty kick guide mark), and conduce an improvement in training efficiency.

Preferably, the marking area is painted on the sphere or sticked on the sphere or printed on the sphere.

In the above example, it is possible to raise the speed and accuracy for arranging a marking area on the sphere and boost the productivity of soccer balls by way of painting, sticking and printing.

An example according to the present invention further provides a soccer training assembly, including a supporting foot marker and the soccer ball as described above, wherein the supporting foot marker includes a laterally-positioning segment, a first marking portion and a second marking portion. The laterally-positioning segment is perpendicular to the section which the initial-targeting guide line lies in during use, and the second marking portion lies at the terminal end of the laterally-positioning segment, the first marking portion is set above the laterally-positioning segment and can freely move above the laterally-positioning segment, so as to adjust the distance between the first marking portion and the second marking portion and to be used to direct the user's supporting foot to a preset landing point on the ground, forming a position relation between the supporting foot and the soccer ball.

In the above example, the supporting foot marker is first placed at an approximate position near a penalty mark on the ground, so that the laterally-positioning segment is perpendicular to a kick route and remains there thereafter. After "correctly placing the ball", the distance of the section which the initial-targeting guide line lies in with respect to the second marking portion is set to be on a length of the radius of the sphere and remains there thereafter by way of translating the ball to the left or right, then a lateral distance between the first marking portion with respect to the section which the initial-targeting guide line lies in and the second marking portion is adjusted by way of sliding the first marking portion on the laterally-positioning segment. Finally, a position of orthographically projecting the laterally-positioning segment on the ground with respect to the hitting-point set is determined by translating the ball forward or backward in the section which the initial-targeting guide line lies in, so as to give a position relation between a supporting foot landing point and an actual hitting point and direct the user's supporting foot to a "correct position", making it easy for the user to repeat a practice to position a supporting foot and improve training effect.

Preferably, the supporting foot marker further includes a length reference segment, and the length reference segment is connected with the laterally-positioning segment and is connected at the position of the second marking portion; the length of the length reference segment is used as a dimension reference for adjusting a distance between the first marking portion and the second marking portion.

In the above example, a length reference segment is bent to be parallel to and overlap the laterally-positioning segment, and the first marking portion is slid to adjust its position with reference to of the length reference segment, so that the position of the first marking portion relative to the second marking portion or an actual hitting point can be quickly adjusted, so as to improve training efficiency.

Preferably, the laterally-positioning segment is made of a soft rope material.

In the above example, it is possible not to easily break the laterally-positioning segment by soccer shoes during use due to the limitation on the material of the laterally-positioning segment, helping to improve the service life of the laterally-positioning segment, so as to ensure training effect.

Preferably, the marking area further includes a penalty kick guide mark, the penalty kick guide mark includes a first penalty kick angle point, a second penalty kick angle point, a third penalty kick angle point and a fourth penalty kick angle point, which are respectively used to guide a user to aim at the four corners of a goal at the time of taking a penalty kick.

In the above example, the place kick includes the penalty kick taken at the penalty spot in front of the goal. The relative positions of the first penalty kick angle point, the penalty kick angle point, the third penalty kick angle point and the penalty kick angle point with respect to the sphere center of the sphere can correspond to the four corners of the goal, respectively; in this way, the user can repeat the action of kicking the ball to the corners of the goal at the time of taking a penalty kick, improving training efficiency and training effect.

Preferably, the area formed by connecting the first penalty kick angle point, the second penalty kick angle point, the fourth penalty kick angle point and the third penalty kick angle point in turn indicates a scope of the hitting points within a goal range aimed at by the user at the time of taking a penalty kick.

In the above example, after connecting the first penalty kick angle point, the second penalty kick angle point, the fourth penalty kick angle point and the third penalty kick angle point in turn, the area defined by the four points corresponds to the scope of the goal, so that the user can repeat the action of kicking a ball at the position within the goal at the time of taking a penalty kick, so as to improve training efficiency and training effect.

Compared with the prior art, the present invention has the following beneficial effect.

The soccer ball and the soccer training assembly can perform a function in guiding the user, so as to make it possible for the user to quickly straighten the ball and quickly direct the foot to a struck target with aid of the initial-targeting guide line and the ball-placing line at the time of training with the soccer ball disclosed by the present invention for practicing a place kick, then quickly completing the "correctly placing the ball", so that the position of each hitting-datum point with respect to the ground, the sphere and the preset struck target are correctly determined, while ensuring that flight directions and trajectories of the ball will keep identical with each other and determined after lots of kicks by way of approaching the ball and striking the ball. In this way, the user can judge whether he has accurately and effectively struck a desired hitting point on the sphere through his full set of striking actions in the light of a ball kicking effect after striking the ball, so as to improve and habituate the elements in the actions, such as a ball-approaching angle and route, a landing supporting foot, a striking posture and a follow-through; thus, the user can form action habits and muscle memory after being familiar with effective actions, so that in the case of kicking a soccer ball that does not have a marking area, the user can also apply the details of the actions skillfully mastered to stably make a ball-kick having a specific effect obtained during training. Therefore, it is possible to improve the training efficiency and effectiveness of practicing a place kick by way of using the soccer ball with the above-mentioned marking area to execute a soccer practice.

BRIEF DESCRIPTION OF THE DRAWINGS

In order to illustrate more clearly the technical solution of the present invention, we shall briefly describe the figures in the examples as follows, but it is understandable that the following figures only indicate some examples of the present invention and should not be regarded as a limitation on the scope of the present invention.

Figure 1:
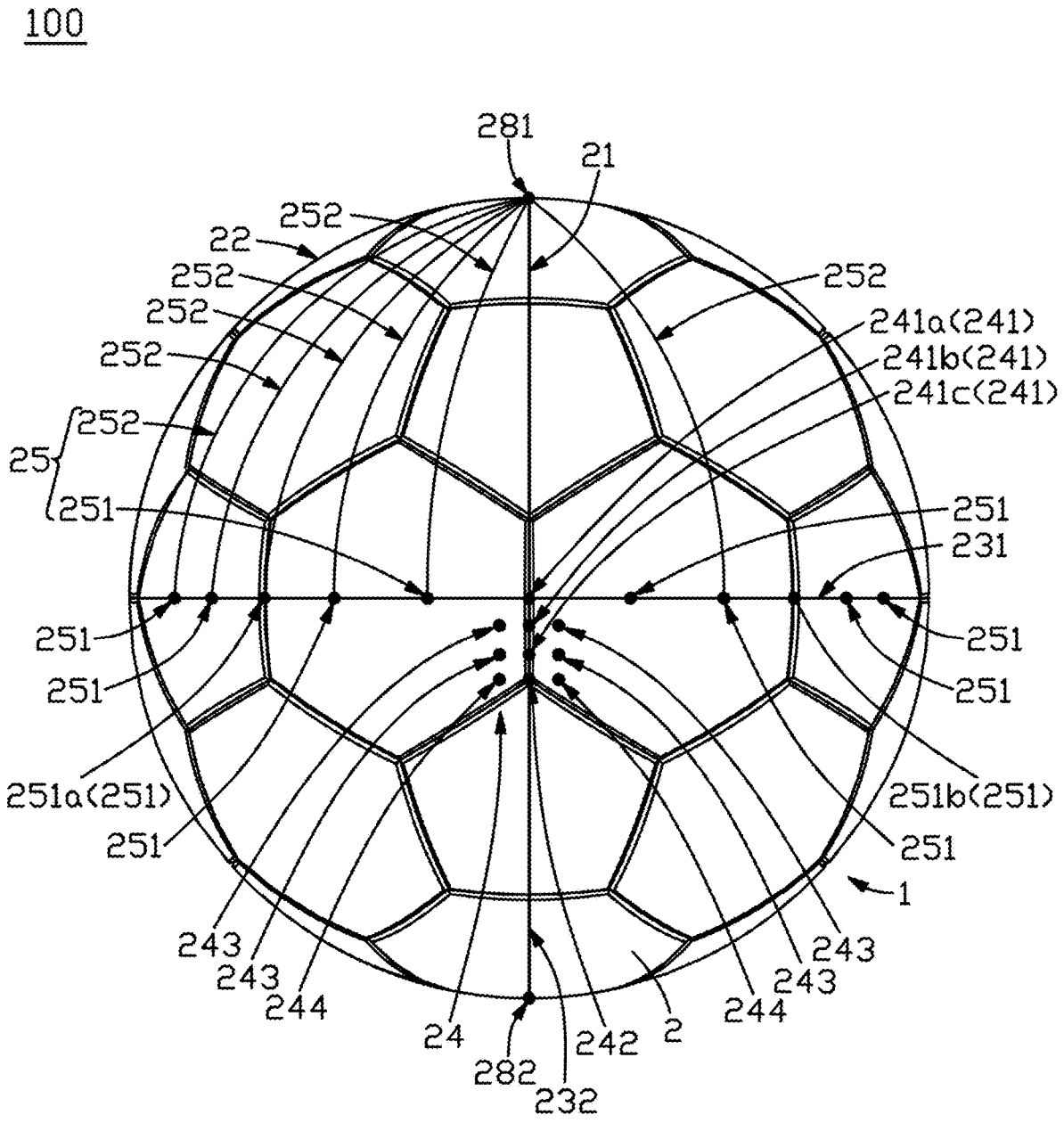
FIG. 1 is a diagram of the soccer ball according to the present invention.

100—soccer ball; 1—sphere; 2—marking area; 21—initial-targeting guide line; 22—ball-placing line; 231—horizontal midline section; 232—central axis; 24—hitting-point set; 241—hitting-datum point; 241*a*—first hitting-datum point; 241*b*—second hitting-datum point; 241*c*—third hitting-datum point; 242—topspin point; 243—first sidespin point; 243*a*—first sidespin point a; 243*b*—first sidespin point b; 244—second sidespin point; 25—ball-approaching guide mark; 251—ball-approaching angle point; 251*a*—first ball-approaching angle point; 251*b*—second ball-approaching angle point; 251A—first ball-approaching route; 251B—second ball-approaching route; 252—ball-approaching guide line; 26—penalty kick guide mark; 261—first penalty kick angle point; 262—second penalty kick angle point; 263—third penalty kick angle point; 264—fourth penalty kick angle point; 265—first simulation-goal line; 266—second simulation-goal line; 267—third simulation-goal line; 268—fourth simulation-goal line; 27—assisting guide mark; 271—mark-assisting hitting line; 272—mark-assisting hitting datum point; 281—first ball-placing point; 282—second ball-placing point; 29—follow-through guide mark; 291—follow-through angle point; 291*a*—first follow-through angle point; 291*b*—second follow-through angle point; 29*a*—first follow-through guide line; 29*b*—second follow-through guide line; 292*a*—first follow-through trajectory; 292*b*—second follow-through trajectory; 200—soccer training assembly; 210—supporting foot marker; 2101—length reference segment; 2102—laterally-positioning segment; 2103—first marking portion; 2104—second marking portion; 1000—user; 1001—kicking-foot; 1002—supporting foot.

DETAILED DESCRIPTION OF SOME EMBODIMENTS

In order to specify the objective, technical solution and advantage of the examples of the present invention, we shall clearly and completely describe the technical solution in the examples of the present invention in combination with the drawings in the examples of the present invention as follows, it is obvious that the described examples are a part of the embodiments of the present invention, but not embody all examples. Normally, the components described and shown herein may be configured and designed through various arrangements.

Therefore, the detailed descriptions in the examples of the present invention provided in the drawings as follows are not intended to limit the scope of the claimed invention, only represent a selected example of the present invention. Based on the examples in the invention, all other examples obtained by a person skilled in the art without doing the creative work belong to the protection scope of the present invention.

It should be noted that similar marks and letters indicate similar items in the drawings as follows, therefore, once an item is defined in a drawing, it does not need to be further defined and explained in subsequent drawings.

In the description of the invention, it should be understood that the orientation or position terms such as "center", "upper", "lower", "left", "right", "vertical", "horizontal", "inner", "outer", based on the orientation or position relationship shown in the figures, only facilitate description to the invention and simplification to the description, do not indicate or imply a certainty for the appointed device or element to have a specific orientation, be constructed and operated in a specific orientation. Therefore, they cannot be construed as a limitation on the invention.

Moreover, the terms "first", "second" and "third" are used for descriptive purposes only and cannot be understood as indicating or implying relative importance.

The terms, such as "horizontal", "vertical" and "overhang", do not mean that a part needs to be absolutely horizontal or overhung, but may be slightly tilted. For example, "horizontal" simply means that an orientation is more horizontal than "vertical", it does not mean that the orientation must be completely horizontal, but that it may be slightly tilted.

In the invention, unless otherwise clearly defined and limited, it should be noted that the terms such as "installation", "connection", "interconnection" should be construed broadly. For example, it may be a a mechanical connection or an electrical connection, it may be an internal passage between two components, it may be a direct connection, or an indirect connection through an intermediate medium, a person skilled in the art can understand the specific meaning of the above-mentioned terms in the invention according to specific circumstances.

It should be noted that, the features in the examples disclosed by the present invention may be combined with each other if they do not conflict with each other. The present invention provides a soccer ball, a soccer training assembly and a training device. The soccer ball has a sphere and a marking area arranged on an outer surface of the sphere. The marking area includes an initial-targeting guide line, a ball-placing line, and a hitting-point set that are respectively arranged on the outer surface of the sphere. The initial-targeting guide line and the ball-placing line lie in diverse sections, each of which is a sectional plane passing through the center of the sphere. The hitting-point set includes a plurality of spaced hitting-datum points, which are arranged on a route defining a section coinciding with the section which the initial-targeting guide line lies in. The defined horizontal midline section is as another sectional plane passing through the center of the sphere, which is parallel to the ground when the section which the initial-targeting guide line lies in and the section which the ball-placing line lies in are both perpendicular to the ground. The plurality of hitting-datum points are arranged downwards from the horizontal midline section.

As mathematically defined, a spatial geometry formed by rotating a semicircle around a straight line where its diameter lies in is called a sphere. The sphere is a three-dimensional geometry with a continuous curved surface, namely a spherical surface, which encloses the geometry. The soccer ball according to the present invention belongs to the sphere defined herein.

All points on the spherical surface are calculated and positioned by means of tools such as a "spherical coordinate system", a "latitude-and-longitude coordinate system", and a "arc length".

Arrangement routes such as an initial-targeting guide line, a ball-placing line, a ball-approaching guide line and a hitting-datum point are circumferential lines formed by intersecting a sectional plane passing through the center of the sphere with the spherical surface of the sphere. After the ball rotating with respect to a user, the lines that lie in the relevant sections in the marking area can be visually overlapped with each other to form a straight line when the use stands right transversally facing these sections (that is, providing that the section extends through the nose, one eye lies before the section, while the other eye lies behind the section). According to the intersection angle relation between the initial-targeting guide line and the ball-placing line with respect to the ground, after the user has rotated the ball in place, when the section which the initial-targeting guide line lies in is perpendicular to the ground, the initial-targeting guide line will be presented as being "perpendicular" to the ground in user's sight; when the section which the ball-placing line lies in is perpendicular to the ground, the ball-placing line will be presented as being "perpendicular" to the ground in user's sight. In addition, when the user stands right transversally facing the section which the initial-targeting guide line lies in and "perpendicular" to the ground, the initial-targeting guide line can be presented as a "straight line" in user's sight, so as to make it possible to indicate the direction. Therefore, it is possible to determine the position of the marking area on the sphere relative to the ground and a kick target, so as to complete "correctly placing the ball", improve the efficiency of placing the ball, and thus enhance training efficiency, by way of placing the ball to enable the sections which the initial-targeting guide line and the ball-placing ball line lie in to be perpendicular to the ground, and the initial-targeting guide line to be directed to a preset target. A plurality of hitting-datum points are located on the section which the initial-targeting guide line lies in, thus it is possible for the user to determine the flight direction of the ball when the user strikes the ball by means of the hitting-datum points by way of directing the "straight line" presented by the initial-targeting guide line to the preset target. After "correctly placing the ball", each hitting-datum point is arranged downwards from the horizontal midline section; thus, the user kicks the ball in the light of the position indicated by each hitting-datum point, so that the ball flies out in the direction indicated by the initial-targeting guide line. In addition, the farther the user's kick at the ball from the horizontal midline section, that is, the lower the hitting-datum points, the higher the ball is kicked out at an angle, so that the user can kick the ball at a corresponding hitting-datum point in the light of the angle corresponding to a height of a kicking to be practiced. It is possible for the user to quickly straighten the ball and quickly direct the foot to a struck target with aid of the initial-targeting guide line and the ball-placing line at the time of training with the soccer ball disclosed by the present invention for practicing a place kick, then quickly completing the "correctly placing the ball", so that the position of each hitting-datum point with respect to the ground, the sphere and the preset struck target are correctly determined, while ensuring that flight directions and trajectories of the ball will keep identical with each other and determined after lots of kicks by way of approaching the ball and striking the ball. In this way, the user can judge whether he has accurately and effectively struck a desired hitting point on the sphere through his full set of striking actions in the light of a ball kicking effect after striking the ball, so as to improve and habituate the elements in the actions, such as a ball-approaching angle and route, a landing supporting foot, a striking posture and a follow-through; thus, the user can form action habits and muscle memory after being familiar with effective actions, so that in the case of kicking a soccer ball that does not have a marking area, the user can also apply the details of the actions skillfully mastered to stably make a ball-kick having a specific effect obtained during training. Therefore, it is possible to improve the training efficiency and effectiveness of practicing a place kick by way of using the soccer ball with the above-mentioned marking area to execute a soccer practice.

After the soccer ball has been correctly placed in accordance with the ball-placing line, all other marking elements on the spherical surface can all be accurately positioned for training use, otherwise their positions will all deviate and make wrong, or even vitiate, so the ball-placing line is one of the priority elements for the soccer ball during use.

Now, we shall describe some embodiments of the present invention in detail in combination with the drawings as follows. If not conflicting with each other, the following examples and the technical features in the examples may be combined with each other.

As shown in FIG. 1, an example according to the present invention provides a soccer ball 100, which is used by the user 1000 (in combination with FIG. 6) for practicing a place kick. The user 1000 can control the flight trajectory of the sphere 1 at the time of taking a place kick by way of using the soccer ball 100 disclosed herein to practice the place kick. Preferably, the sphere 1 has a bladder (not shown in the figures.) and a soccer covering that wraps the bladder, and the soccer covering and the bladder are spherical and have a coinciding sphere center.

Figure 2:
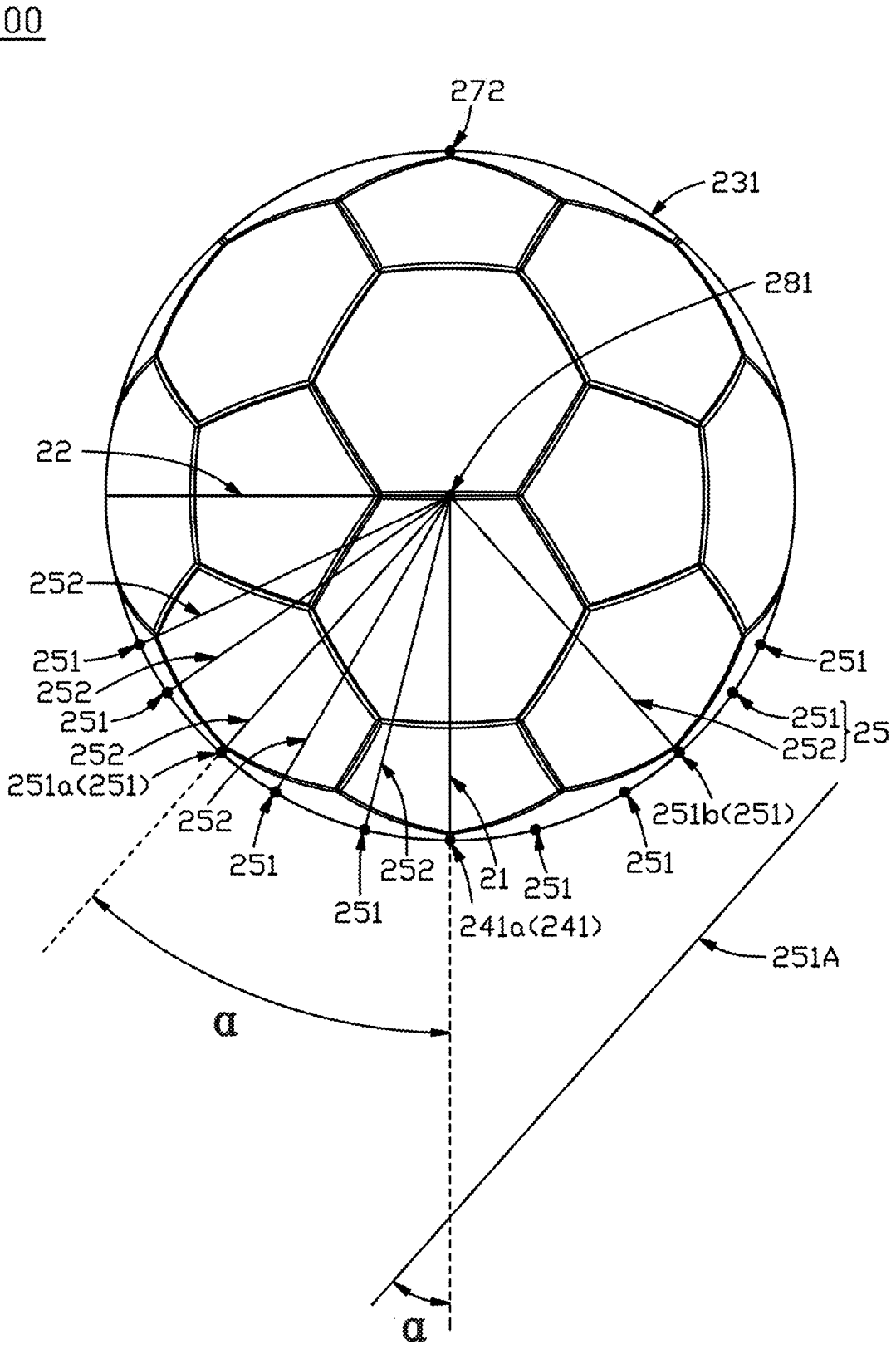
FIG. 2 is a diagram of the soccer ball according to the present invention.

As shown in FIGS. 1 and 2, preferably, the soccer ball 100 has a sphere 1 and a marking area 2 arranged on the surface of the sphere 1. The marking area 2 includes an initial-targeting guide line 21, a ball-placing line 22, and a hitting-point set 24 that are respectively arranged on the outer surface of the sphere. It is understandable that the marking area 2 is preferably arranged on the surface of the soccer covering.

The soccer ball 100 has the sphere 1 and the marking area 2 arranged on the surface of the sphere 1. The marking area 2 includes the initial-targeting guide line 21, the ball-placing line 22, and the hitting-point set 24 that are respectively arranged on the outer surface of the sphere.

The initial-targeting guide line 21 and the ball-placing line 22 are positioned in different sections, each of which is a sectional plane passing through the center of the sphere 1. The hitting-point set 24 includes a plurality of spaced hitting-datum points 241, which are arranged on a route defining a section coinciding with the section which the initial-targeting guide line 21 lies in. The defined horizontal midline section 231 is as another sectional plane passing through the center of the sphere 1. A defined central axis 232 is as an intersecting line between the section which the initial-targeting guide line 21 lies in and the section which the ball-placing line 22 lies in.

A horizontal midline section 231 is parallel to the ground and the central axis 232 is perpendicular to the ground when the section which the initial-targeting guide line 21 lies in and the section which the ball-placing line 22 lies in are both perpendicular to the ground, a plurality of hitting-datum points 241 are arranged downwards from the horizontal midline section 231.

Arrangement routes such as the initial-targeting guide line 21, the ball-placing line 22 and the hitting-datum points 241 are circumferential lines formed by intersecting the section passing through the center of the sphere 1 with the spherical surface of the sphere 1. After the ball rotating with respect to the user 1000, the lines that lie in the marking area 2 can be visually overlapped with each other to form a straight line. According to the intersection angle relation between the initial-targeting guide line 21 and the ball-placing line 22 with respect to the ground, after the user 1000 has rotated the ball in place to adjust the position of the sphere 1 on the ground, when the section which the initial-targeting guide line 21 lies in is perpendicular to the ground, the initial-targeting guide line 21 will be presented as being "perpendicular" to the ground in user 1000 sight; when the section which the ball-placing line 22 lies in is perpendicular to the ground, the ball-placing line 22 will be presented as being "perpendicular" to the ground in user 1000 sight. In addition, when the user 1000 stands right transversally facing the section which the initial-targeting guide line 21 lies in, the initial-targeting guide line 21 can be presented as a "straight line" in user 1000 sight, so as to make it possible to indicate the direction. A plurality of hitting-datum points 241 lie in the section which the initial-targeting guide line 21 lies in, thus it is possible for the user to determine the flight direction of the sphere 1 when the user 1000 strikes the ball by means of the hitting-datum points 241 by way of directing the "straight line" presented by the initial-targeting guide line 21 to a preset target.

Therefore, it is possible to determine the position of the marking area 2 on the sphere 1 relative to the ground, so as to complete "correctly placing the ball", improve the efficiency of placing the ball, and thus enhance training efficiency, by way of placing the sphere 1 to enable the sections which the initial-targeting guide line 21 and the ball-placing ball line 22 lie in to be perpendicular to the ground, and the initial-targeting guide line 21 to be directed to the preset target. Therefore, the step of "correctly placing the ball" includes: (1) making the initial-targeting guide line 21 "perpendicular" to the ground; (2) making the ball-placing line 22 "perpendicular" to the ground; and (3) rotating the soccer ball in place to direct the initial-targeting guide line 21 to a preset direction.

After "correctly placing the ball", each hitting-datum point 241 is arranged downwards from the horizontal midline section 231; thus, the user 1000 kicks the ball in the light of the position indicated by each hitting-datum point 241, so that the sphere 1 flies out in the direction indicated by the initial-targeting guide line 21. In addition, the farther the user's kick at the ball from the horizontal midline section 231, that is, the lower the hitting-datum points 241, the higher the sphere 1 is kicked out at an angle (an intersection angle of the initial-targeting guide line with respect to the ground), so that the user can kick the ball at a corresponding hitting-datum point 241 in the light of the angle corresponding to a height of a kicking to be practiced.

It is possible for the user 1000 to quickly straighten the ball and quickly direct the foot to a struck target with aid of the initial-targeting guide line 21 and the ball-placing line 22 at the time of training with the soccer ball disclosed by the present invention for practicing a place kick, then quickly completing the "correctly placing the ball", so that the position of each hitting-datum point 241 with respect to the ground, the sphere 1 and the preset struck target are correctly determined, while ensuring that flight directions and trajectories of the ball will keep identical with each other and determined after lots of kicks by way of approaching the ball and striking the ball. In this way, the user 1000 can judge whether he has accurately and effectively struck a desired hitting point on the sphere 1 through his full set of striking actions in the light of a ball kicking effect after striking the ball, so as to improve and habituate the elements in the actions, such as a ball-approaching angle and route, a landing supporting foot 1002, a striking posture and a follow-through; thus, the user can form action habits and muscle memory after being familiar with effective actions, so that in the case of kicking a soccer ball 100 that does not have a marking area 2, the user can also apply the details of the actions skillfully mastered to stably make a ball-kick having a specific effect obtained during training. Therefore, it is possible to improve the training efficiency and effectiveness of practicing a place kick by way of using the soccer ball 100 with the above-mentioned marking area 2 to execute a soccer practice.

As shown in FIGS. 1 and 2, preferably, an intersection angle of the two ends of the initial-targeting guide line 21 with respect to the sphere center of the sphere 1 is 90°. An intersection angle of two ends of the ball-placing line 21 with respect to the sphere center of the sphere 1 is 90°. One end of the initial-targeting guide line 21 is connected with one end of the ball-placing line 22 and extends to one end of the central axis 232, and the other end of the initial-targeting guide line 21 and the other end of the ball-placing line 22 are all positioned at the horizontal midline section 231. It is understandable that the section which the initial-targeting guide line 21 lies in and the section which the ball-placing line 22 lies in are preferably perpendicular to each other.

Preferably, the initial-targeting guide line 21 may be a line that is continuously extended, or a line that is not continuously extended such as a dashed line, a dotted line and a double dotted line. The ball-placing line 22 may be a line that is continuously extended, or a line that is not continuously extended such as a dashed line, a dotted line and a double dotted line. The hitting-datum point 241 includes, but not limited to, an intersecting point between two lines, a circular point, an elliptical point, a triangle point, a square point and a polygona point, and it may be solid or hollow.

Figure 5:
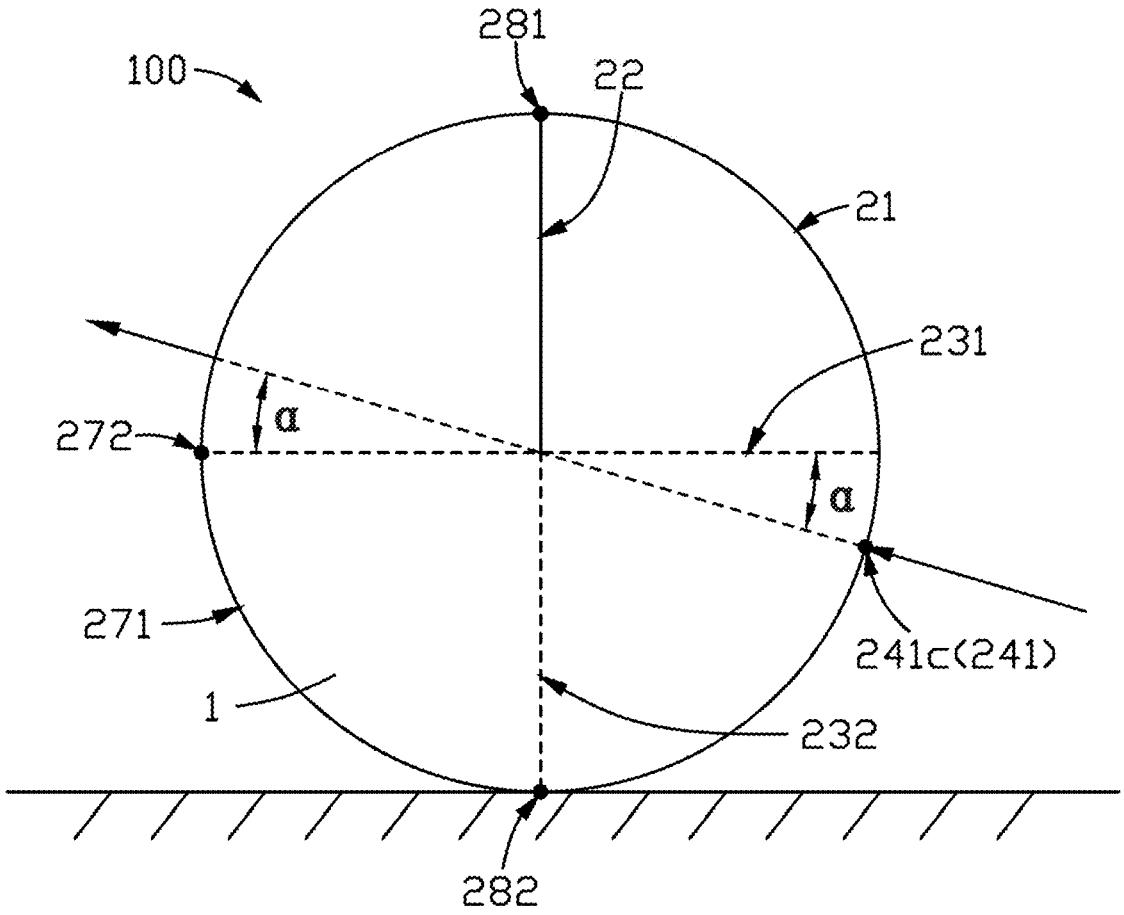
FIG. 5 is a reference diagram of the flight direction of the soccer ball according to the present invention.

As shown in FIGS. 1 and 5, preferably, an intersection angle of the two adjacent hitting-datum points 241 with respect to the sphere center of the sphere 1 represents an intersection angle between the flight trajectories of the sphere 1 struck at the two hitting-datum points 241. As an exemplary example, the hitting-datum point 241*a* positioned in the horizontal midline section 231 is used to practice a place kick with a trajectory skimming the ground, the hitting-datum point 241*b* is used to practice a place kick with a flight trajectory at an elevation angle of 8.4°, and the hitting-datum point 241*c* is used to practice a place kick with a flight trajectory at an elevation angle $\alpha$ of 14.7°. In the case of using a standard #5 size ball with a circumference of 69 cm as the sphere 1, an arc length between the hitting-datum point 241*b* and the hitting-datum point 241*a* is 1.61 cm, and an arc length between the hitting-datum point 241*c* and the hitting-datum point 241*a* is about 2.82 cm.

Figure 7:
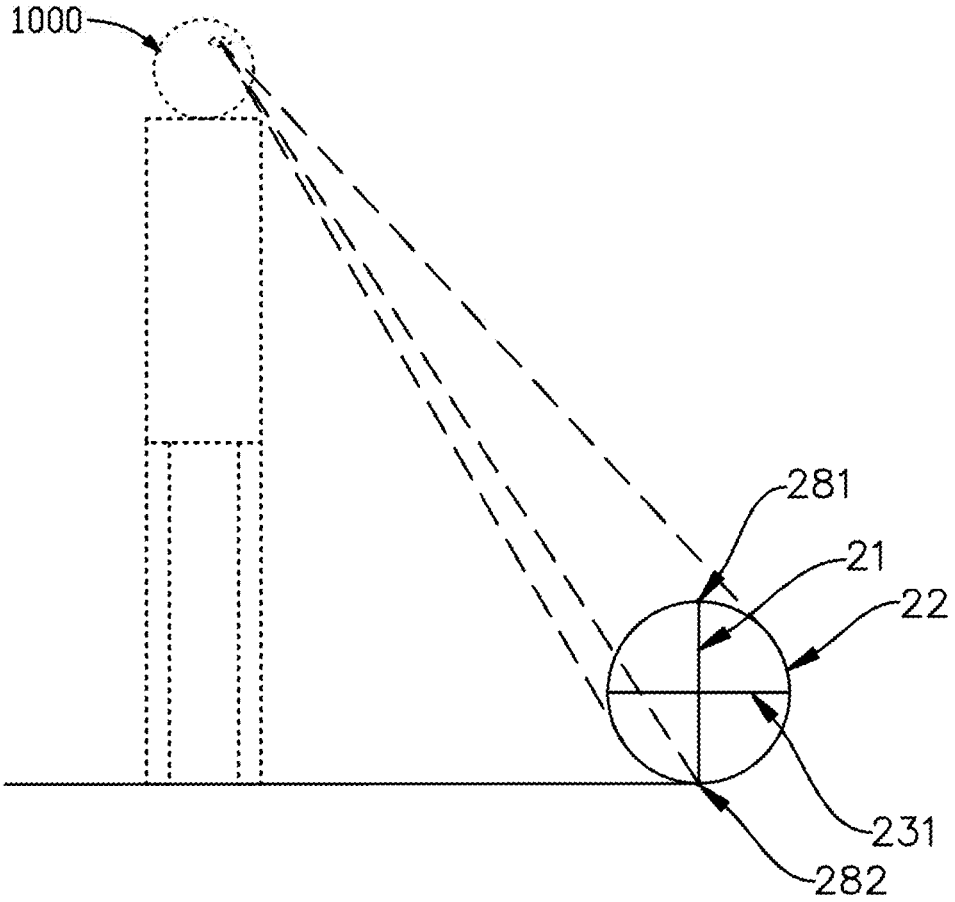
FIG. 7 is a diagram showing user's sight on the soccer ball according to the present invention.

As shown in FIG. 7, in the examples disclosed herein, if the ball-placing line 22 is not narrowly arranged as a reference, even if all other steps are correct, the horizontal midline section 231 of the sphere 1 cannot be truly parallel to the ground; subsequently, all hitting-point set 24 cannot truly lie in the correct position. At the absence of the ball-placing line 22, the user can only rely on feeling and estimation to place the ball, causing all point/line elements to be absolutely mispositioned on the spherical surface. Therefore, the ball-placing line 22 is a must-have and priority element.

Specifically, take a shot to the upper left corner of the goal at the penalty area line 18Y/16.5 m as an example, please refer to Table 1 as follows:

TABLE 1

| deference of placing the ball | distance of the hitting point below the horizontal midline | angel of kicked out | height of the ball passing through the goal | height over the goal |
|---|---|---|---|---|
| 0 | 1.53 cm | 8° | 244 cm | 0 |
| 0.5 cm | 2.03 cm | 10.59° | 316 cm | 72 cm |
| 1 cm | 2.53 cm | 13.2° | 398 cm | 154 cm |

Even if the section which the initial-targeting guide line 21 lies in is correctly perpendicular to a kick out direction and absolutely correctly directed, that is, no deviation occurs to the kicking in the left and right directions, if the first ball-placing point 281 cannot be really accurately positioned at the top, a slight deviation occurring to the first ball-placing point 281 forward or backward causes a large deviation in ascent angle of kicked out (as shown in Table 1, if the first ball-placing point deviates backwards by 1 cm, the soccer ball 100 will go beyond a crossbar by 154 cm); therefore, it is necessary to ensure that the central axis 232 is perpendicular to the ground by adopting a rigorous measure.

It should be noted that the top and the bottom of the defined central axis have a first ball-placing point 281 and a second ball-placing point 282, respectively, but if the two ball-placing points are used separately, it is impossible to achieve placing the ball. In terms of visual sense, people can observe the two ball-placing points at the same time under the condition that his eyes must be level with the sphere center (about 11 cm above the ground, and the eye's head needs to be close to the ground) and his eyes needs to be at an infinite distance from the soccer ball 100, which is obviously difficult to do on a soccer field.

As shown in FIG. 7, in fact, because the human body is usually in a natural standing posture at the time of observing and placing the ball, the height of the human eye from the ground is between 1.5 m~2 m (slightly less than the height of the human body), and the standing position is usually within a distance from the soccer 100 by a few meters, as well as the vertex of the soccer ball 100 can usually be seen, but due to eye's high position the base point of the soccer ball 100 close to the grass (that is, the height relative to the ground is about 0) will be obscured at the time of observing the bottom, it is impossible to directly observe the defined central axis, that is, it is impossible to use the defined central axis to assist in correctly placing the ball. However, the height of the horizontal midline 231 of the soccer ball is about 11 cm, visually presented as an arc, so it is impossible to directly judge whether the horizontal midline 231 is really parallel to the ground.

In this way, it is necessary to solve the problem by using the ball-placing line 22, which is a line formed by intersecting the section passing through the two ends of the defined central axis (which can be formed by "three points and one face") with the spherical surface. People can easily judge in a natural posture whether the soccer ball is placed accurately on the basis whether the ball-placing line is perpendicular to the ground, and can easily adjust a hitting point to a correct position.

After the soccer ball 100 has been correctly placed in accordance with the ball-placing line 22, all other marking elements (including a logo) on the spherical surface can all be accurately positioned for training use, otherwise their positions will all deviate and make wrong, or even vitiate, so the ball-placing line 22 is one of the priority elements for the soccer ball 100 during use.

As shown in FIGS. 1 and 2, preferably, the marking area 2 further includes a ball-approaching guide mark 25. The ball-approaching guide mark 25 has a plurality of ball-approaching angle points 251. The intersection angles between the sections which the diverse ball-approaching angle points 251 and the central axis 232 lie in and the section which the initial-targeting guide line 21 lies in are different. The section which each ball-approaching angle point 251 and the central axis 232 lie in is called "ball-approaching section".

It should be noted that each striking action must include ball-approaching, and it is required that the intersection angles between the ball-approaching direction and the kick out direction at the time of approaching the ball for different striking actions differ respectively so as to achieve a desired follow-through angle; in this way, only the ball-approaching guide mark can be directed to a correct ball-approaching angle.

When a user 1000 takes a place kick, the user 1000 approaches a ball in different directions relative to the ball, thus influencing the direction of the force applied from a user's kicking-foot 1001 at the time of kicking the ball. Each "ball-approaching section" forms an intersecting angle with the section which the initial-targeting guide line 21 lies in, making it possible to indicate a ball-approaching angle to the user 1000. After "correctly placing the ball", the user 1000 stands right transversally facing the "ball-approaching section" (that is, providing that the section extends through the nose, one eye lies before the section, while the other eye lies behind the section), the "ball-approaching section" may be visually presented as a "straight line", which can be used to indicate an intersection angle for approaching the ball relative to a direction of kicking the ball, to the user 1000, in this way, it is convenient for the user 1000 to repeat training in different ball-approaching directions, and enhance training efficiency and training effect.

As shown in FIGS. 1 and 2, preferably, the ball-approaching guide mark 25 further includes a plurality of ball-approaching guide lines 252. Each ball-approaching angle point 251 is set on a respective ball-approaching guide line 252. When the section which the initial-targeting guide line 21 lies in and the section which the ball-placing line 22 lies in are both perpendicular to the ground, the section which each ball-approaching guide line 252 lies in is perpendicular to the ground. The section which each ball-approaching guide line 252 lies in is the "ball-approaching section" of the ball-approaching angle point 251 corresponding to the ball-approaching guide line 252.

The section which the ball-approaching guide line 252 lies in is the "ball-approaching section" which the ball-approaching angle point 251 corresponding to the ball-approaching guide line 252 and the central axis 232 lie in; after "correctly placing the ball", a user 1000 stands right transversally facing the "ball-approaching section" which the corresponding ball-approaching angle point 251 lies in; the ball-approaching guide line 252 will be presented as a "straight line" in user 1000 sight, which can be used to indicate an intersection angle between the approaching direction and the kick out direction, improving the user 1000 recognition for a ball-approaching direction, and helping to enhance training efficiency and training effect of training the user 1000 for a ball-approaching direction.

As shown in FIGS. 1 and 2, preferably, a plurality of ball-approaching angle points 251 may lie in the horizontal midline section 231. A plurality of ball-approaching angle points 251 may lie on one side of the hitting-datum point 241 positioned in the horizontal midline section 231 at an angle ranging from 0~90° with respect to the sphere center of the sphere 1, or on the other side of the hitting-datum point 241 positioned in the horizontal midline section 231 at an angle ranging from 0~90° with respect to the sphere center of the sphere 1, or on the both sides of the hitting-datum point 241 positioned in the horizontal midline section 231 at an angle ranging from 0~90° with respect to the sphere center of the sphere 1.

As an exemplary example, the ball-approaching angle point 251*a* and the ball-approaching angle point 251*b* both lie in the horizontal midline section 231. An intersection angle of the ball-approaching angle point 251*a* and the hitting-datum point 241 positioned in the horizontal midline section 231 with respect to the sphere center of the sphere 1 is 45°, while an intersection angle of the ball-approaching angle point 251*b* and the hitting-datum point 241 positioned in the horizontal midline section 231 with respect to the sphere center of the sphere 1 is 45°; the ball-approaching angle point 251*a* is used to indicate an approaching angle of 45° on the left side, while the ball-approaching angle point 251*b* is used to indicate an approaching angle of 45° on the right side, and the other ball-approaching angle points 251 may be used to indicate approaching angles such as 30°, 60° and 70°, respectively.

Preferably, the ball-approaching angle point 251 includes, but not limited to, an intersecting point between two lines, a circular point, an elliptical point, a triangle point, a square point and a polygona point, or a special-shaped point, and it may be solid or hollow.

As shown in FIGS. 1 and 2, preferably, one end of each ball-approaching guide line 252 is connected with the ball-approaching angle point 251, and the other end of each ball-approaching guide line 252 is connected with one end of the initial-targeting guide line 21 and one end of the ball-placing line 22.

Preferably, the ball-approaching guide line 252 may be a line that is continuously extended, or a line that is not continuously extended such as a dashed line, a dotted line and a double dotted line.

Preferably, the ball-approaching guide line 252 is omitted at the place which some ball-approaching angle points 251 used by a left-footed player lie at, so as to make it easy for the user 1000 to identify the marking area 2 at the time of using the soccer ball 100. In addition, retaining the ball-approaching angle points 251 makes it convenient for the user 1000 to draw a ball-approaching guide line 252 according to actual needs.

As shown in FIG. 1, preferably, the hitting-point set 24 includes a topspin point 242. The topspin point 242 is spaced with the hitting-datum point 241. The topspin point 242 lies in the section which a plurality of hitting-datum points 241 lie in. When the section which the initial-targeting guide line 21 lies in and the section which the ball-placing line 22 lies in are both perpendicular to the ground, the topspin point 242 lies below one of several hitting-datum points 241.

When a user 1000 takes a place kick, he kicks the ball at a kick out angle in accordance with a "hitting point at a target height" but applies topspin to the ball by way of applying a force passing through a portion above the sphere center rather than passing through the sphere center on a portion below the striking position at the target height. After "correctly placing the ball", the topspin point 242 lies below the hitting-datum point 241 corresponding to it, so the user 1000 kicks the ball towards the topspin point 242, so as to make it possible to apply topspin to the ball with respect to the hitting-datum point 241; as a result, the user 1000 can repeat a topspin practice, improving training efficiency and training effect.

Preferably, a plurality of topspin points 242 are set. Each topspin point 242 lies on a side of a respective hitting-datum point 24 that deviates from the initial-targeting guide line 21.

Preferably, the topspin point 242 includes, but not limited to, an intersecting point between two lines, a circular point, an elliptical point, a triangle point, a square point and a polygona point, or a special-shaped point, and it may be solid or hollow.

As shown in FIG. 1, preferably, the hitting-point set 24 further includes a first sidespin point 243 and a second sidespin point 244. In the direction perpendicular to the section which the initial-targeting guide line 21 lies in, the first sidespin point 243 is spaced with one of several hitting-datum points 241. In the direction perpendicular to the section which the initial-targeting guide line 21 lies in, the second sidespin point 244 is spaced with the topspin point 242.

When a user 1000 takes a place kick, he kicks the ball at a kick out angle in accordance with a "hitting point at a target height" but applies sidespin to the ball by way of applying a force passing through a side of the sphere center rather than passing through the sphere center on a side of the target striking position. After "correctly placing the ball", the user 1000 may regard the horizontal midline section 231 as the "equator" position of the sphere 1, thus the first sidespin point 243 and the hitting-datum point 241 corresponding to it lie at a "parallel" position near the "equator" position, while the second sidespin point 244 and the topspin point 242 corresponding to it lie at a "parallel" position near the "equator" position; in this way, after "correctly placing the ball", the first sidespin point 243 lies on a side of the hitting-datum point 241 corresponding to it, while the second sidespin point 244 lies on a side of the topspin point 242 corresponding to it, so the user 1000 kicks the ball towards the second sidespin point 244, so as to make it possible to apply "side-top-spin" to the ball with respect to the topspin point 242; as a result, the user 1000 can repeat a sidespin practice, improving training efficiency and training effect.

As shown in FIG. 1, preferably, the distance between the first sidespin point 243 and the horizontal midline section 231 is equal to the distance between the hitting-datum point 241 and the horizontal midline section 231. The distance between the second sidespin point 244 and the horizontal midline section 231 is equal to the distance between the topspin point 242 and the horizontal midline section 231.

Preferably, an intersection angle of the first sidespin point 243 and the horizontal midline section 231 with respect to the sphere center of the sphere 1 and an intersection angle of the hitting-datum point 241 and the horizontal midline section 231 with respect to the sphere center of the sphere 1 deviate from each other by 5°. An intersection angle of the second sidespin point 244 and the horizontal midline section 231 with respect to the sphere center of the sphere 1 and an intersection angle of the topspin point 242 and the horizontal midline section 231 with respect to the sphere center of the sphere 1 deviate from each other by 5°.

As shown in FIG. 1, it is understandable that the first sidespin point 243 is preferably set on both the left and right sides of the hitting-datum point 241 and the second sidespin point 244 is preferably set on both the left and right sides of the topspin point 242 after "correctly placing the ball", so as to enable the user 1000 to practice a sidespin kick by way of approaching the ball from the left side or the right side, and touching the ball with the left foot or the right foot.

Preferably, a plurality of first sidespin points 243 are set. Each two first sidespin points 243 lie on both sides of a respective hitting-datum point 241 perpendicular to the section which the initial-targeting guide line 21 lies in. Preferably, a plurality of second sidespin points 244 are set. Each two second sidespin points 244 lie on both sides of a respective topspin point 242 perpendicular to the section which the initial-targeting guide line 21 lies in.

Preferably, the first sidespin point 243 includes, but not limited to, an intersecting point between two lines, a circular point, an elliptical point, a triangle point, a square point and a polygona point, or a special-shaped point, and it may be solid or hollow. The second sidespin point 244 includes, but not limited to, an intersecting point between two lines, a circular point, an elliptical point, a triangle point, a square point and a polygona point, or a special-shaped point, and it may be solid or hollow.

Figure 8:
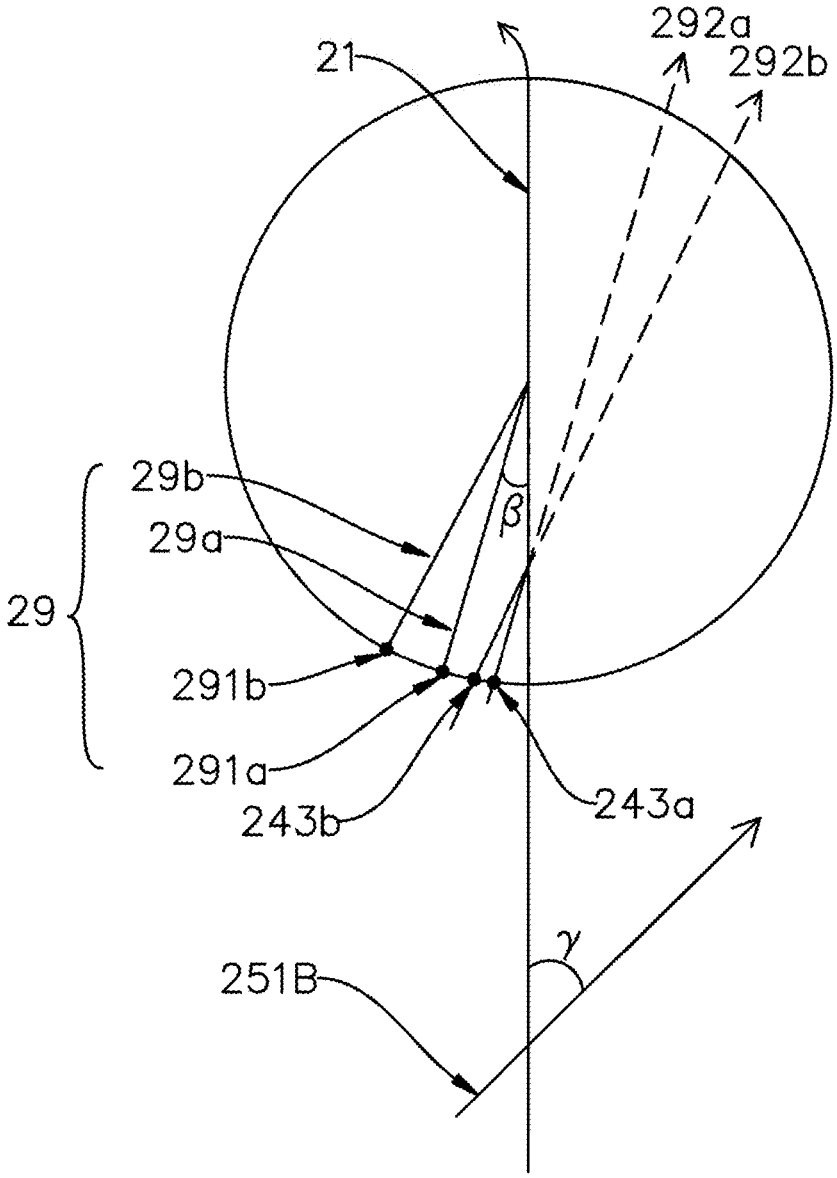
FIG. 8 is a diagram of the second ball-approaching route according to the present invention.

As shown in FIG. 8, it is also possible to the defined central axis as an intersecting line between the section which the initial-targeting guide line 21 lies in and the section which the ball-placing line 22 lies in. The marking area 2 further includes a follow-through guide mark 29, and the follow-through guide mark 29 includes a plurality of follow-through angle points 291, wherein the follow-through angle points 291 includes the first follow-through angle point 291*a* and/or the second follow-through angle point 291*b*; intersection angles between the sections which diverse follow-through angle points 291 and the central axis lie in and the section which the initial-targeting guide line lies in are different from each other.

A follow-through action (it may also be understood as a ball-following/foot-sending action) refers to a following action with a specific displacement direction and trajectory made by a contact portion of the foot that touches a hitting point on the ball surface at the time of striking the ball. Diverse types of ball-striking actions require different initial follow-through angles.

Specifically, when the user takes a place kick, taking a follow-through action in different directions with respect to the soccer ball will influence the direction of the force applied by the user's foot at the time of kicking the ball.

In addition, the section which each follow-through angle point 291 and the central axis lie in and the section which the initial-targeting guide line 21 lies in form an intersection angle, which is used to direct the lateral angle of the user's follow-through.

Preferably, the follow-through guide mark further includes a plurality of follow-through guide lines, wherein the follow-through guide line includes the first follow-through guide line 29*a* and/or the second follow-through guide line 29*b*, and each follow-through angle point 291 is set at a respective follow-through guide line. When the section which the initial-targeting guide line 21 lies in and the section which the ball-placing line 22 lies in are both perpendicular to the ground, the section which each follow-through guide line lies in is perpendicular to the ground.

In the above example, the section which the follow-through guide line lies in is the section which the follow-through angle point 291 and the central axis lie in; after "correctly placing the ball", a user stands right transversally facing the section which the follow-through guide line corresponding to the follow-through angle to be practiced;

the follow-through guide line will be presented as a "straight line" in user's sight, which can be used to indicate a direction, improving the user's recognition for a follow-through direction, and helping to enhance training efficiency and training effect of training the user for a follow-through direction.

It should be noted that at the time of "volleying the ball into sidespin by the inner instep", a player approaches the ball along the second ball-approaching route 251B at a γ angle with respect to a kick out direction, where γ=45°, after a supporting foot 1002 lands on the ground, the direction which the supporting foot 1002 points to and the (lateral) direction which the kicking-foot 1001 follows through to be sent toward will generally be about the same with each other, and both will form an intersection angle of about 30° with the ball-approaching route, at this time, the initial direction (lateral) of following through to send the foot and the direction (lateral) of delivering the kick will automatically form an angle difference B, where β=15°.

At this time, if the section which the follow-through guide line lies in is also set at an angle of 15° with respect with the section which the initial-targeting guide line 21 lies in, when the kicking-foot 1001 kicks at the first sidespin point a 243*a* with an inner portion of the metatarsal on the upper instep, the initial direction (lateral) which the foot actually follows through to be sent toward will be naturally parallel to the first follow-through guide line 29*a* at 15° on the ball surface; in this way, the soccer ball 100 will generate stable sidespin and fly forward exactly in the direction of the initial-targeting guide line 21. It is helpful to determine whether the actual follow-through (lateral) angle is correct by observing whether the initial direction of the actual first follow-through trajectory 292*a* in the lateral direction is parallel to the first follow-through guide line 29*a* on the ball, allowing the user to practice and habituate a posture that generate a natural and stable angle which the foot follows through (laterally) to be sent at.

In addition, it is possible to further observe whether the sphere rotation displacement correspondingly generated following the above follow-through angle is appropriate and effective (setting left/right displacement that makes the soccer ball 100 generate a side-spin arc at a distance), for example, it is possible to adjust the action as approaching the ball at 60° to kick at the sidespin point b 243*b* to generate an actual second follow-through trajectory 292*b* parallel to the second follow-through guide line 29*b* in the figure and at a 30° lateral intersection angle with respect to the kick out direction; in this way, the rotation displacement generated by the soccer ball 100 at this time is different from the left/right displacement generated at the time of laterally following through to send the foot at 15° while approaching the ball at 45°. The above adjustments and tests can help the user find an appropriate ball-approaching angle and follow-through angle.

Figure 3:
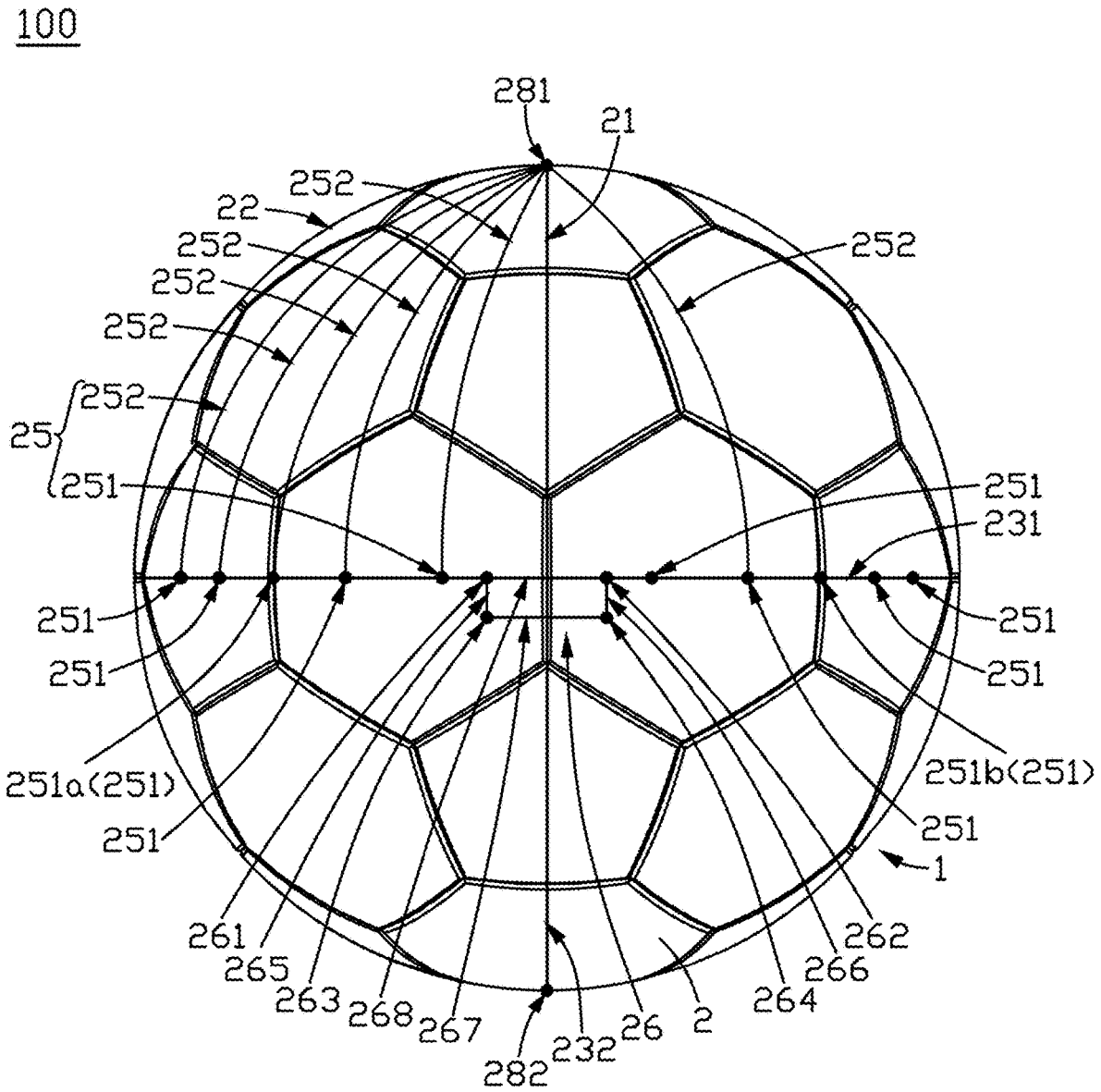
FIG. 3 is a diagram of the soccer ball according to the present invention.

As shown in FIG. 3. preferably, the marking area 2 further includes a penalty kick guide mark 26. The penalty kick guide mark 26 includes a first penalty kick angle point 261, a second penalty kick angle point 262, a third penalty kick angle point 263 and a fourth penalty kick angle point 264, which are respectively used to guide the user 1000 to aim at the four corners of the goal at the time of taking a penalty kick.

The place kick includes the penalty kick taken at the penalty spot in front of the goal. The relative positions of the first penalty kick angle point 261, the penalty kick angle point 262, the third penalty kick angle point 263 and the penalty kick angle point 264 with respect to the sphere center of the sphere 1 can correspond to the four corners of the goal, respectively; in this way, the user 1000 can repeat the action of kicking the ball to the corners of the goal at the time of taking a penalty kick, improving training efficiency and training effect.

As shown in FIG. 3, preferably, the first penalty kick angle point 261 and the second penalty kick angle point 262 lie in the horizontal midline section 231. The first penalty kick angle point 261 and the second penalty kick angle point 262 are spaced with each other. During use, the initial-targeting guide line 21 is directed to the middle of the goal, and the distance between the first penalty kick angle point 261 and the initial-targeting guide line 21 is equal to the distance between the second penalty kick angle point 262 and the initial-targeting guide line 21. An intersection angle of the first penalty kick angle point 261 and the second penalty kick angle point 262 with respect to the sphere center of the sphere is 35-39°. The section which the third penalty kick angle point 263, the first penalty kick angle point 261 and the sphere center of the sphere of sphere 1 lie in is perpendicular to the horizontal midline section 231. An intersection angle of the third penalty kick angle point 263 and the first penalty kick angle point 261 with respect to the sphere center of the sphere 1 is 10.4-12.4°. The section which the fourth penalty kick angle point 264, the second penalty kick angle point 262 and the sphere center of the sphere of sphere 1 lie in is perpendicular to the horizontal midline section 231. An intersection angle of the fourth penalty kick angle point 264 and the second penalty kick angle point 262 with respect to the sphere center of the sphere 1 is 10.4-12.4°. When the section which the initial-targeting guide line 21 lies in and the section which the ball-placing line 22 lies in are both perpendicular to the ground, the third penalty kick angle point 263 and the fourth penalty kick angle point 264 both lie below the horizontal midline section 231.

It is possible to convert the distance from the penalty point to the goal (usually 12 yards, about 10.97 m), the size of the goal (usually 8 yards in width, about 7.32 m, 8 feet in height, about 2.44 m), and the size of the sphere 1 (taking a standard #5 size ball as example, about 22 cm in diameter) into an intersection angle of the lower left corner of the goal and the lower right corner of the goal with respect to the penalty point as about 36.9, an intersection angle of the upper left corner of the goal with respect to the horizontal midline section 231 as about 11.4°, and an intersection angle of the upper right corner of the goal with respect to the horizontal midline section 231 as about 11.4°, after "correctly placing the ball". Thus, the relative positions of the first penalty kick angle point 261, the second penalty kick angle point 262, the third penalty kick angle point 263 and the fourth penalty kick angle point 264 with respect to the sphere center of the sphere 1 can roughly correspond to the four corners of the goal, respectively; in this way, the user 1000 can repeat the action of kicking the ball to the corners of the goal at the time of taking a penalty kick, improving training efficiency and training effect.

As shown in FIG. 3, preferably, after "correctly placing the ball", when the first penalty kick angle point 261 lies at the hitting-datum point 241 arranged in the horizontal midline section 231 of the sphere 1, the first penalty kick angle point 261 corresponds to the lower right corner of the goal, the second penalty kick angle point 262 corresponds to the lower left corner of the goal, the third penalty kick angle point 263 corresponds to the upper right corner of the goal, and the fourth penalty kick angle point 264 corresponds to the upper left corner of the goal.

As an exemplary example, an intersection angle of the first penalty kick angle point 261 and the second penalty kick angle point 262 with respect to the sphere center of the sphere is 35°, 36°, 36.9°, 37°, 37.5°, 38°, 38.5°, 39° and the likes; an intersection angle of the third penalty kick angle point 263 and the first penalty kick angle point 261 with respect to the sphere center of the sphere 1 is 10.4°, 11°, 11.4°, 12°, 12.4° and the likes; an intersection angle of the fourth penalty kick angle point 264 and the second penalty kick angle point 262 with respect to the sphere center of the sphere 1 is 10.4°, 11°, 11.4°, 12°, 12.4° and the likes.

As shown in FIG. 3, preferably, the area formed by connecting the first penalty kick angle point 261, the second penalty kick angle point 262, the fourth penalty kick angle point 264 and the third penalty kick angle point 263 in turn indicates a scope of the hitting points within a goal range aimed at by the user 1000 at the time of taking a penalty kick.

After connecting the first penalty kick angle point 261, the second penalty kick angle point 262, the fourth penalty kick angle point 264 and the third penalty kick angle point 263 in turn, the area defined by the four points corresponds to the scope of the goal, so that the user 1000 can repeat the action of kicking a ball at the position within the goal at the time of taking a penalty kick, so as to improve training efficiency and training effect.

The penalty kick guide mark 26 further includes a first simulation-goal line 265, a second simulation-goal line 266, a third simulation-goal line 267, and a fourth simulation-goal line 268. The two ends of the first simulation-goal line 265 are connected to the first penalty kick angle point 261 and the third penalty kick angle point 263, respectively. The section which the first simulation-goal line 265 lies in coincides with the section which the first penalty kick angle point 261 and the central axis 232 lie in. The two ends of the second simulation-goal line 266 are connected to the second penalty kick angle point 262 and the fourth penalty kick angle point 264, respectively. The section which the second simulation-goal line 266 lies in coincides with the section which the second penalty kick angle point 262 and the central axis 232 lie in. The two ends of the third simulation-goal line 267 are connected to the third penalty kick angle point 263 and the fourth penalty kick angle point 264, respectively. The two ends of the fourth simulation-goal line 267 are connected to the first penalty kick angle point 261 and the second penalty kick angle point 262, respectively. The section which the fourth simulation-goal line 268 lies in coincides with the section which the horizontal midline section 231 lies in.

As shown in FIGS. 1 and 3, preferably, the initial-targeting guide line 21, the ball-placing line 22 and the ball-approaching guide mark 25 are provided in multiple groups, the hitting-point set 2 is related to the position of one of the groups, while the penalty kick guide mark 26 is related to the position of another group. Preferably, the hitting-point set 24 and the penalty kick guide mark 26 may be related to the position of the group concurrently containing the initial-targeting guide line 21, the ball-placing line 22 and the ball-approaching guide mark 25.

Preferably, the first penalty kick angle point 261, the second penalty kick angle point 262, the third penalty kick angle point 263 and the fourth penalty kick angle point 264 respectively include, but not limited to, an intersecting point between two lines, a circular point, an elliptical point, a triangle point, a square point and a polygona point, or a special-shaped point, and they may be solid or hollow. The first simulation-goal line 265, the second simulation-goal line 266, the third simulation-goal line 267, and the fourth simulation-goal line 268 may respectively be a line that is continuously extended, or a line that is not continuously extended such as a dashed line, a dotted line and a double dotted line.

Figure 4:
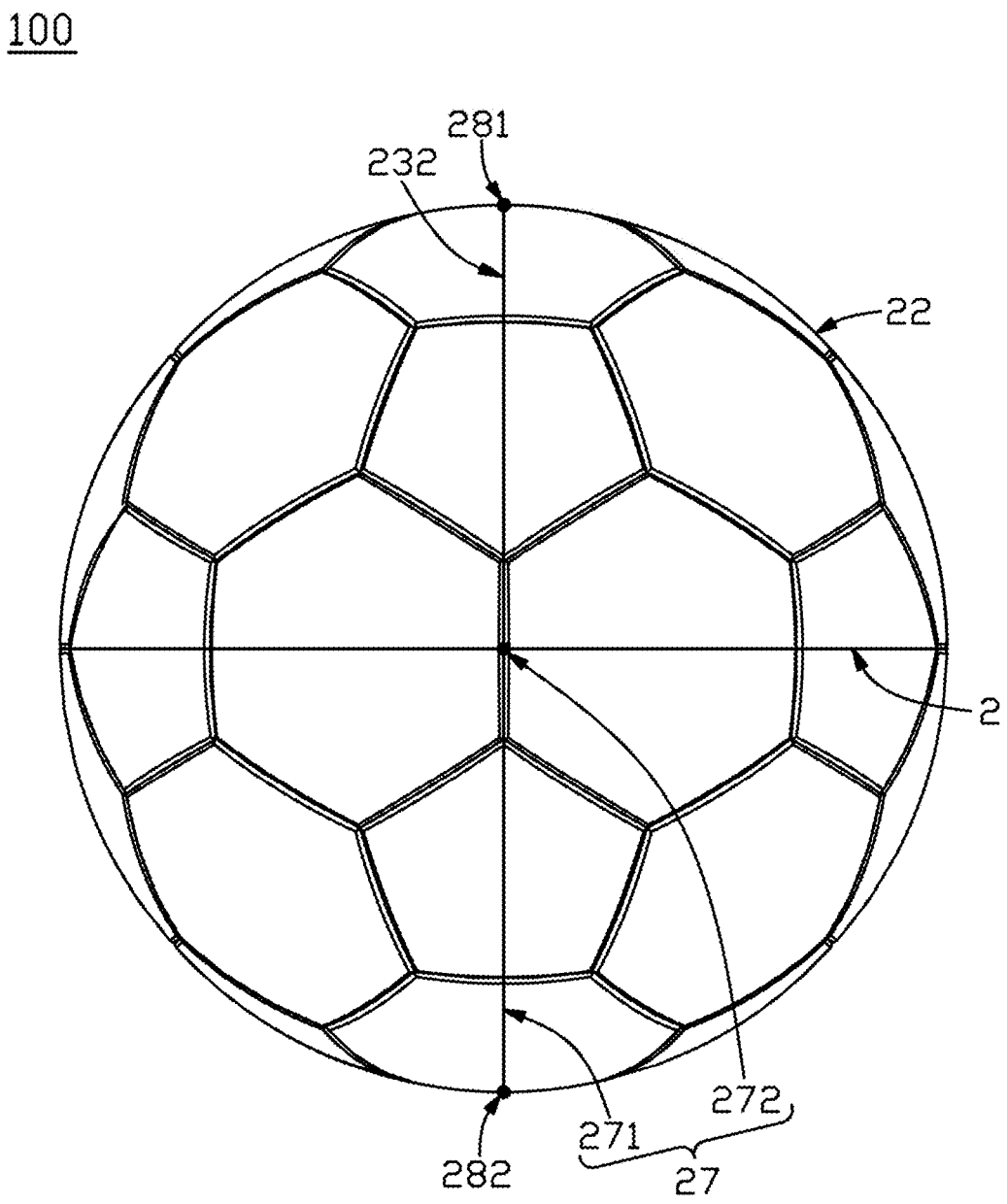
FIG. 4 is a diagram of the soccer ball according to the present invention.

As shown in FIGS. 2 and 4, preferably, the marking area further includes an assisting guide mark 27, which includes a mark-assisting hitting line 271. When the section which the initial-targeting guide line 21 lies in and the section which the ball-placing line 22 lies in are both perpendicular to the ground, the section which the mark-assisting hitting line 271 lies in is perpendicular to the ground.

After "correctly placing the ball", the section which the mark-assisting hitting line 271 lies in is also perpendicular to the ground, and the mark-assisting hitting line can also be presented as a "straight line" in user 1000 sight, so as to point to the direction of striking a target ball; thus, the user 1000 can draw a point or a line near the undermentioned reference position, such as the hitting-point set 24, the ball-approaching guide mark 25 and the penalty kick guide mark 26 according to needs and use the mark-assisting hitting line 271 with reference to the initial-targeting guide line 21, by way of taking the mark-assisting hitting line 271 and the position (a center point) at which the mark-assisting hitting line 271 is intersected with the horizontal midline section 231 as a reference, so as to study and trial a new striking effect. In this way, the user 1000 can adjust a training target according to his actual needs, and enhance training efficiency and training effect.

Preferably, one end of the mark-assisting hitting line 271 is connected to one end of the initial-targeting guide line 21. The section which the mark-assisting hitting line 271 lies in coincides with the section which the initial-targeting guide line 21 lies in.

As shown in FIGS. 2 and 4, preferably, the assisting guide mark 27 further includes a mark-assisting hitting datum point 272, which lies at the intersection at which the mark-assisting hitting line 271 is intersected with the horizontal midline section 231. The mark-assisting hitting datum point 272 acts as a reference point for the hitting-datum point 241 set on the horizontal midline section 231.

It should be noted that a completely-blank area beyond the mark-assisting hitting line 271 exists near this intersection, and the spherical surface of this blank area is made of non-PVC material that can be colored with an oil-based marker. It is possible to add auxiliary marks in this blank area such as the hitting-point set, the ball-approaching guide mark and the follow-through guide mark for various desired effect.

Preferably, when the section which the initial-targeting guide line 21 lies in and the section which the ball-placing line 22 lies in are both perpendicular to the ground, and the initial-targeting guide line 21 and the ball-placing line 22 lie above the horizontal midline section 231, the mark-assisting hitting line 271 lies below the horizontal midline section 231.

Preferably, the mark-assisting hitting line 271 may be a line that is continuously extended, or a line that is not continuously extended such as a dashed line, a dotted line and a double dotted line. The mark-assisting hitting datum point 272 includes, but not limited to, an intersecting point between two lines, a circular point, an elliptical point, a triangle point, a square point and a polygona point, or a special-shaped point, and they may be solid or hollow.

As shown in FIGS. 1 and 2, preferably, the marking area further includes a first ball-placing point 281 and a second ball-placing point 282. The first ball-placing point 281 and the second ball-placing point 282 respectively lie on the both ends of the central axis 232.

Preferably, after "correctly placing the ball", one of the first ball-placing point 281 and the second ball-placing point 282 should lie at the top of the sphere 1, and the other should lie at the bottom of the sphere 1; thus the user 1000 can assist in adjusting the placement posture of the sphere 1 with aid of the position of the first ball-placing point 281 and the second ball-placing point 282 relative to the ground, and make it possible for a left-footed/right-footed player to use most of the original marks on the outer surface of the sphere 1 (except for a hitting-point set/penalty kick guide mark) by way of reversing the positions of the first ball-placing point 281 and the second ball-placing point 282, so as to improve the accuracy and efficiency for placing the sphere 1, and conduce an improvement in training efficiency.

Preferably, the first ball-placing point 281 includes, but not limited to, an intersecting point between two lines, a circular point, an elliptical point, a triangle point, a square point and a polygona point, or a special-shaped point, and they may be solid or hollow. The second ball-placing point 282 includes, but not limited to, an intersecting point between two lines, a circular point, an elliptical point, a triangle point, a square point and a polygona point, or a special-shaped point, and they may be solid or hollow.

Preferably, the initial-targeting guide line 21, the ball-placing line 22, the hitting-datum point 241, the topspin point 242, the first sidespin points 243, the second sidespin points 244, the ball-approaching guide mark 25, the penalty kick guide mark 26, the assisting guide mark 27, the first ball-placing point 281, the second ball-placing point 282 and the follow-through guide mark 29 may be provided in an identical color, or may respectively be provided in different colors.

Preferably, the marking area 2 is painted on the sphere 1 or sticked on the sphere 1 or printed on the sphere 1.

It is possible to raise the speed and accuracy for arranging the marking area 2 on the sphere 1 and boost the productivity of soccer balls 100 by way of painting, sticking and printing.

Figure 6:
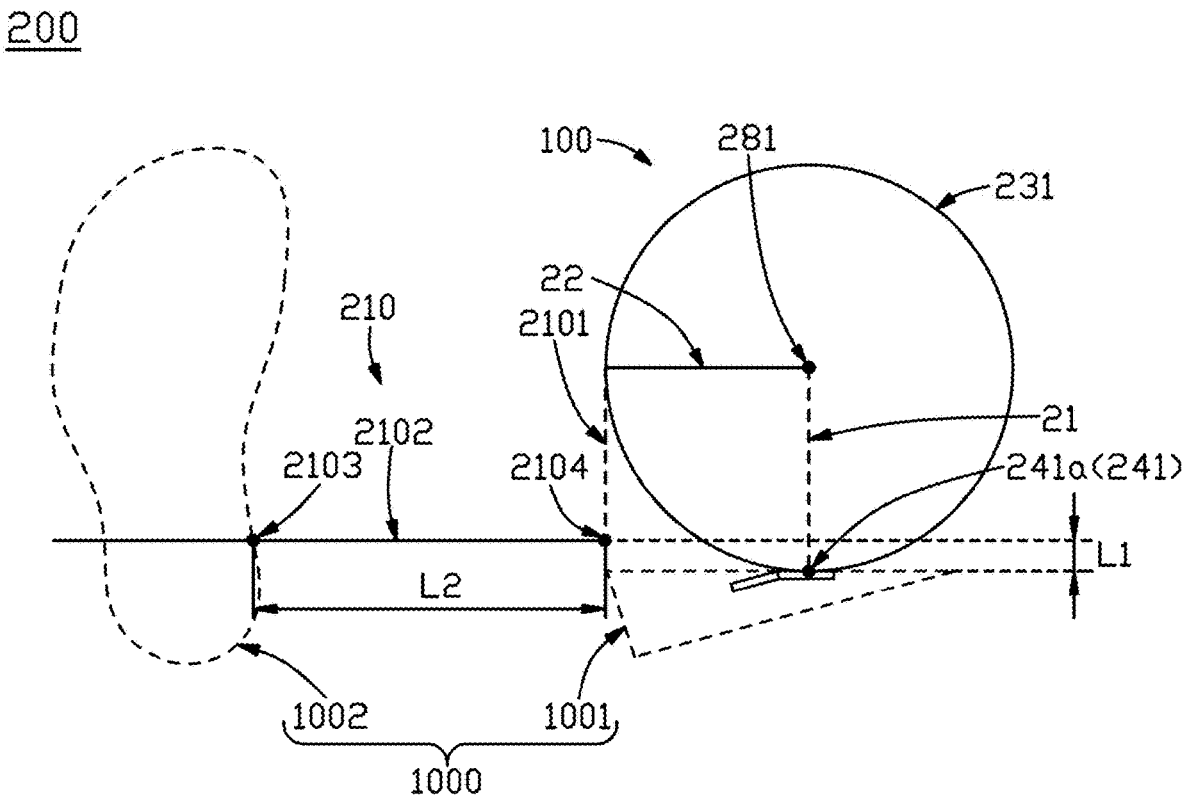
FIG. 6 is a structure diagram showing a coordination relation between a user and the soccer training assembly according to the present invention.

As shown in FIG. 6, preferably, the soccer ball 100 is used in ways of placing the ball, approaching the ball, striking the ball and following through.

Placing the ball: take the initial-targeting guide line 21 and the ball-placing line 22 as a visual reference, so as to make the initial-targeting guide line 21 visually "perpendicular" to the ground, and the ball-placing line 22 visually "perpendicular" to the ground; then rotate the sphere 1, so as to direct the initial-targeting guide line 21 to a preset target position.

Approaching the ball: in the light of a ball-approaching angle to be practiced, select a corresponding ball-approaching angle point 251 or ball-approaching guide line 252, and keep a preset distance from the sphere 1 in the direction indicated by the ball-approaching angle point 251 or the ball-approaching guide line 252, so as to enable the section which the ball-approaching angle point 251 and the central axis 232 lie in, that is, a ball-approaching section to be presented a "straight line" in user 1000 sight, and form an intersecting line with the ground, and enable the ball-approaching guide line 252 to be presented as a "straight line" in user 1000 sight; then, select an applicable route parallel to the "intersecting line between the ground and the ball-approaching section" as a final ball-approaching route by way of translating the body to the left or the right. As an exemplary example, as shown in FIG. 2, the final ball-approaching route corresponding to the ball-approaching angle point 251*a* is the first ball-approaching route 251A, in FIG. 2, the first ball-approaching route 251A is parallel to the ball-approaching section corresponding to the ball-approaching angle point 251*a*.

Striking the ball: aim at one among the hitting-datum point 241, the topspin point 242, the first sidespin points 243, the second sidespin points 244 and the penalty kick guide mark 26 to be practiced, then approach the sphere 1 and finally strike the position on the sphere 1 with the kicking-foot 1001.

In the related technology, when the user 1000 is practicing a place kick, in order to form action habits and muscle memory, at the moment of striking the ball, a distance relation between the position touched by the kicking-foot 1001 and the supporting foot 1002 of the user 1000 is basically stationary. However, the position (the metatarsal on the upper instep) touched by the kicking-foot 1001 of the user 1000 is stationary with respect to the touched position of the sphere 1 every time of practicing. In the case that the position of the supporting foot 1002 relative to the sphere 1 changes every time of practicing, in order to keep the kicking-foot 1001 touching the ball at a designated position and touching a designated position of the sphere 1, the body posture of the user 1000 needs to be forced to make a corresponding adjustment, resulting in a deformed action, and inability to naturally and forcefully touch the ball, leading to poor kick quality and decrease in training effect. Therefore, it is necessary to keep the user 1000 supporting foot 1002 stationary with respect to the position of the sphere 1.

As shown in FIG. 6, the present invention provides a soccer training assembly 200, which includes a supporting foot marker 210 and the soccer ball 100 as described in the above examples.

The supporting foot marker 210 includes a laterally-positioning segment 2102, a first marking portion 2103 and a second marking portion 2104. The laterally-positioning section 2102 is configured to be capable of bearing an external force and deforming, and to be perpendicular to the section which the initial-targeting guide line 21 lies in during use. The second marking portion 2104 lies at the terminal end of the laterally-positioning segment 2102. The first marking portion 2103 is disposed on the laterally-positioning segment 2102 and can slide freely on the laterally-positioning segment 2102, so as to adjust the distance between the first marking portion 2103 and the second marking portion 2104 and guide the user 1000 supporting foot 1002 to land at a preset point on the ground, constituting the position relation between the supporting foot 1002 and the soccer ball 100.

It should be noted that the laterally-positioning segment 2102 may be made of a soft rope that will not be broken by soccer shoes, avoiding the laterally-positioning segment 2102 from smashing under the soccer shoes after long-term use.

The soccer ball 100 generates a mathematical "orthographic projection" on the ground (similar to a visual angle that the human eyes lie directly above the soccer ball 100 to look down at the soccer ball 100) presented as a perfect circle, and the orthographic projections of all points on the spherical surface (including the hitting points) will also lie at a stationary position in this perfectly circular orthographic projection of the sphere 1 on the ground; in addition, respective orthographic projection relations between all points on the spherical surface (for example, the hitting-datum points 241*b* and 241*a*) are also stationary on the ground. Referring to FIG. 6, FIG. 6 shows the diagrams of the orthographic projections corresponding to each structure.

An actual hitting point lies at a fixed height above the "orthographic projection of the hitting point" on the ground, so the position relation between the actual hitting point and the "orthographic projection of the hitting point" on the ground is stationary. It is possible to determine a position relation between a landing point of the supporting foot 1002 and an actual hitting point by way of adjusting the two-dimensional position relation between the first marking portion 2103 on the ground (indicating a landing point of the supporting foot 1002) and the orthographic projection of the specific hitting point on the ground.

The supporting foot marker 210 is first placed at an approximate position near a penalty mark on the ground, so that the laterally-positioning segment 2102 is perpendicular to a kick route and remains there thereafter. After "correctly placing the ball", the distance of the section which the initial-targeting guide line 21 lies in with respect to the second marking portion 2104 of the supporting foot marker 210 is set to be on a length of the radius of the sphere 1 and remains there thereafter by way of translating the ball to the left or right. Then a lateral distance of the first marking portion 2103 with respect to the section which the initial-targeting guide line 21 lies in is adjusted by way of sliding the first marking portion 2103 on the laterally-positioning segment 2102. Finally, a position of orthographically projecting the laterally-positioning segment 2102 on the ground with respect to the hitting-point set 24 is determined by translating the ball forward or backward in the section which the initial-targeting guide line 21 lies in, so as to give a position relation between a landing point of the supporting foot 1002 and an actual hitting point and direct the user 1000 supporting foot 1002 to a "correct position", making it easy for the user 1000 to repeat a practice to position a supporting foot 1002 and improve training effect.

As an exemplary example, the first marking portion 2103 is used to indicate how to position the middle inner sole or the inner ankle of the user 1000 supporting foot 1002.

As shown in FIG. 6, preferably, the supporting foot marker 210 further includes a length reference segment 2101. The length reference segment 2101 is connected with the laterally-positioning segment 2102 and is connected at the position of the second marking portion 2104. The length of the length reference segment 2101 is used as a dimension reference for adjusting the distance between the first marking portion 2103 and the second marking portion 2104, or as a reference for the vertical distance between the extension direction of the laterally-positioning segment 2102 and the orthographic projection of the hitting-point set 24.

The length reference segment 2101 is bent to be parallel to and overlap the laterally-positioning segment 2012, and the first marking portion 2103 is slid to adjust its position with reference to of the length reference segment 2101, so that the position of the first marking portion 2103 relative to the second marking portion 2104 or an actual hitting point can be quickly adjusted, so as to improve training efficiency.

As shown in FIG. 6, preferably, the length reference segment 2101 is configured to be capable of bearing an external force and deforming, and to be parallel to the section which the initial-targeting guide line 21 lies in during use. At the time of using the supporting foot marker 210, the length of the length reference segment 2101 can also be used as a a reference for the vertical distance between the extension direction of the laterally-positioning segment 2102 and the orthographic projection of the hitting-point set 24, so as to determine the relative position between the laterally-positioning segment 2102 and the hitting-point set 24 in the extension direction of the laterally-positioning segment 2102.

Preferably, the length reference segment 2101 and the laterally-positioning segment 2102 are provide in a rope structure that can be bent and deformed.

As shown in FIG. 6, preferably, the length reference segment 2101 and the laterally-positioning segment 2102 are provided in an integrated shaped structure. It is easy to carry and place the integrated shaped length reference segment 2101 and laterally-positioning segment 2102, and the length reference segment 2101 and the laterally-positioning segment 2102 are connected with each other stably, so as to reduce possibility of separation during training the user 1000, and prolong service life.

Preferably, the length reference segment 2101 and the laterally-positioning segment 2102 are provided in a split structure which may be formed by a single rope or a combination of multiple ropes.

As shown in FIG. 6, preferably, the length reference segment 2101 and the laterally-positioning segment 2102 are connected with each other by tying a knot.

It is convenient to set the length of the length reference segment 2101 (for example, set as a diameter length of a standard #5 size ball or a standard #4 size ball) by tying a knot, so that the position of the orthographic projection of the relative hitting-point set 24 can be adjusted as needed.

As shown in FIG. 6, preferably, the first marking portion 2103 is tied to the laterally-positioning segment 2102 by respectively tying a knot with another short rope. Preferably, the first marking portion 2103 may be tied to the laterally-positioning segment 2102 by tying a knot with themselves.

As an exemplary example, when a standard #5 size ball having a circumference of 69 cm is used as the sphere, the vertical distance L1 (FIG. 6 indicates the vertical distance between the extension line of the laterally-positioning segment 2102 and the orthographic projection of the hitting-datum point 241*a*) between the extension line of the laterally-positioning segment 2102 and the orthographic projection of the hitting-point set 24 is about 2.2 cm (approximately 10% of the diameter of sphere 1), and the distance L2 between the first marking portion 2103 and the second marking portion 2104 is about 15.4 cm (approximately 70% of the diameter of sphere 1); in this way, the position of the first marking portion 2103 can satisfies that the vertical distance L1 between the extension line of the laterally-positioning segment 2102 and the orthographic projection of the hitting-point set 24 is about 2.2 cm, and in the direction perpendicular to the section which the initial-targeting guide line 21 lies in, the lateral distance between the first marking portion 2103 and the orthographic projection of the hitting-point set 24 is about 26.4 cm.

As shown in FIG. 6, preferably, the soccer training assembly 200 is used in ways of orientating the rope, placing the ball, moving the ball, approaching the ball, landing the supporting foot and striking the ball. Orientating the rope: firstly, place the supporting foot marker 210 at an approximate position near a penalty mark on the ground, then orientate the laterally-positioning segment 2102 and the length reference segment 2101, so that the laterally-positioning segment 2102 is perpendicular to the kick route and remains there thereafter, and the length reference segment 2101 is parallel to the kick route and remains there thereafter, finally adjust the position of the first marking portion

2103 and adjust the distance L2 of the first marking portion 2103 with respect to the second marking portion 2104 until suitability.

Placing the ball: make the initial-targeting guide line 21 "perpendicular" to the ground and the ball-placing line 22 "perpendicular" to the ground; then rotate the sphere 1 in place, so as to direct the initial-targeting guide line 21 to a preset target position.

Moving the ball: set the distance of the section which the initial-targeting guide line 21 lies in with respect to the second marking portion 2104 of the supporting foot marker 210 to be on a length of the radius of the sphere 1 and remains there thereafter by way of translating the soccer ball 100 to the left or right (at this time, the length reference segment 2101 keeps a "tangent" relation with respect to a circumferential line orthographically projected by the sphere 1 on the ground), finally, determine a position of orthographically projecting the extension line of the laterally-positioning segment 2102 on the ground with respect to the hitting-point set 24 by translating the sphere 1 forward or backward in the direction which the initial-targeting guide line 21 points to, so as to give a position relation between a landing point of the supporting foot 1002 and an actual hitting point and direct the user 1000 supporting foot 1002 to a "correct position", making it easy for the user 1000 to repeat a practice to position a supporting foot 1002 and improve training effect.

Approaching the ball: in the light of a ball-approaching angle to be practiced, select a corresponding ball-approaching angle point 251 or ball-approaching guide line 252, and keep a preset distance from the sphere 1 in the direction indicated by the ball-approaching angle point 251 or the ball-approaching guide line 252, so as to enable the section which the ball-approaching angle point 251 and the central axis 232 lie in, that is, a ball-approaching section to be presented a "straight line" in user 1000 sight, and form an intersecting line with the ground, and enable the ball-approaching guide line 252 to be presented as a "straight line" in user 1000 sight; then, select an applicable route parallel to the "intersecting line between the ground and the ball-approaching section" as a final ball-approaching route by way of translating the body to the left or the right. As an exemplary example, as shown in FIG. 2, The final ball-approaching route corresponding to the ball-approaching angle point 251*a* is the first ball-approaching route 251A, in FIG. 2, the first ball-approaching route 251A is parallel to the ball-approaching section corresponding to the ball-approaching angle point 251*a*.

Landing the supporting foot: after approaching the ball, make a specified position on the sole of the supporting foot 1002 (for example, a position of the middle inner sole or the inner ankle of the user 1000 supporting foot 1002) overlap a position where the first marking portion 2103 of the supporting foot marker 210 is set on the ground.

Striking the ball: aim at one among the hitting-datum point 241, the topspin point 242, the first sidespin points 243, the second sidespin points 244 and the penalty kick guide mark 26 to be practiced, and finally strike the position on the sphere 1 with the kicking-foot 1001.

In present invention, the various "lines" of the marking area 2 are linear areas having a certain width, and the various "points" are punctate areas having a certain diameter.

In addition, a person skilled in the art should realize that the above examples are only used to explain the present invention, not pose a limitation on the present invention, and appropriate modifications and changes within the scope of the essence of the present invention made to the above examples fall within the disclosure scope of the present invention.

INDUSTRIAL APPLICABILITY

In summary, the present invention provides a soccer ball and the soccer training assembly that can perform a function in guiding the user, so as to make it possible for the user to quickly straighten the ball and quickly direct the foot to a struck target with aid of the initial-targeting guide line and the ball-placing line at the time of training with the soccer ball disclosed by the present invention for practicing a place kick, then quickly completing the "correctly placing the ball", so that the position of each hitting-datum point with respect to the ground, the sphere and the preset struck target are correctly determined, while ensuring that flight directions and trajectories of the ball will keep identical with each other and determined after lots of kicks by way of approaching the ball and striking the ball. In this way, the user can judge whether he has accurately and effectively struck a desired hitting point on the sphere through his full set of striking actions in the light of a ball kicking effect after striking the ball, so as to improve and habituate the elements in the actions, such as a ball-approaching angle and route, a landing supporting foot, a striking posture and a follow-through; thus, the user can form action habits and muscle memory after being familiar with effective actions, so that in the case of kicking a soccer ball that does not have a marking area, the user can also apply the details of the actions skillfully mastered to stably make a ball-kick having a specific effect obtained during training. Therefore, it is possible to improve the training efficiency and effectiveness of practicing a place kick by way of using the soccer ball with the above-mentioned marking area to execute a soccer practice.

What is claimed is:

1. A soccer ball, comprising: a sphere and a marking area arranged on an outer surface of said sphere, said marking area having an initial-targeting guide line, a ball-placing line, and a hitting-point set that are respectively arranged on the outer surface of said sphere;

wherein said initial-targeting guide line and said ball-placing line lie in diverse sections, each of which is a sectional plane passing through the center of said sphere, said hitting-point set includes a plurality of spaced hitting-datum points, which are arranged on a route defining a section coinciding with the section which said initial-targeting guide line lies in, a defined horizontal midline section is as another sectional plane passing through the center of said sphere;

said horizontal midline section is parallel to the ground when the section which said initial-targeting guide line lies in and the section which said ball-placing line lies in are both perpendicular to the ground, said plurality of hitting-datum points are arranged downwards from said horizontal midline section.

2. The soccer ball according to claim 1, wherein a defined central axis is as an intersecting line between the section which said initial-targeting guide line lies in and the section which said ball-placing line lies in, said marking area further includes a ball-approaching guide mark, said ball-approaching guide mark has a plurality of ball-approaching angle points, intersection angles between sections which said diverse ball-approaching angle points and said central axis lie in and the section which said initial-targeting guide line lies in are different from each other.

3. The soccer ball according to claim 2, wherein said ball-approaching guide mark further includes a plurality of ball-approaching guide lines, each said ball-approaching angle point is set on a respective said ball-approaching guide line;

when the section which said initial-targeting guide line lies in and the section which said ball-placing line lies in are both perpendicular to the ground, a section which each said ball-approaching guide line lies in is perpendicular to the ground.

4. The soccer ball according to claim 1, wherein a defined central axis is as an intersecting line between the section which said initial-targeting guide line lies in and the section which said ball-placing line lies in, said marking area further includes a follow-through guide mark, and said follow-through guide mark includes a plurality of follow-through angle points;

intersection angles between sections which said diverse follow-through angle points and said central axis lie in and the section which said initial-targeting guide line lies in are different from each other.

5. The soccer ball according to claim 4, wherein said follow-through guide mark further includes a plurality of follow-through guide lines, and each said follow-through angle point is set at a respective said follow-through guide line; when the section which said initial-targeting guide line lies in and the section which said ball-placing line lies in are both perpendicular to the ground, a section which each said follow-through guide line lies in is perpendicular to the ground.

6. The soccer ball according to claim 1, wherein said hitting-point set further includes a first sidespin point;

in a direction perpendicular to the section which said initial-targeting guide line lies in, said first sidespin point is spaced with one of said hitting-datum points.

7. The soccer ball according to claim 1, wherein said hitting-point set includes a topspin point, which is spaced with said hitting-datum point, said topspin point lies in the section which said plurality of hitting-datum points lie in;

when the section which said initial-targeting guide line lies in and the section which said ball-placing line lies in are both perpendicular to the ground, said topspin point lies below one of said hitting-datum points.

8. The soccer ball according to claim 7, wherein said hitting-point set further includes a second sidespin point;

in a direction perpendicular to the section which said initial-targeting guide line lies in, said second sidespin point is spaced with said topspin point.

9. The soccer ball according to claim 1, wherein said marking area further includes an assisting guide mark, which includes a mark-assisting hitting line and a mark-assisting hitting datum point, said mark-assisting hitting datum point lies at an intersection at which said mark-assisting hitting line is intersected with said horizontal midline section;

when the section which said initial-targeting guide line lies in and the section which said ball-placing line lies in are both perpendicular to the ground, the section which said mark-assisting hitting line lies in is perpendicular to the ground.

10. The soccer ball according to claim 9, wherein a completely-blank area exists near said intersection, and said completely-blank area lies apart from said mark-assisting hitting line.

11. The soccer ball according to claim 1, wherein a defined central axis is as an intersecting line between the section which said initial-targeting guide line lies in and the section which said ball-placing line lies in, and said marking area further includes a first ball-placing point and a second ball-placing point; said first ball-placing point and said second ball-placing point respectively lie on both ends of said central axis.

12. The soccer ball according to claim 1, wherein said marking area is painted on said sphere or sticked on said sphere or printed on said sphere.

13. A soccer training assembly, comprising a supporting foot marker and the soccer ball as claimed in claim 1, wherein said supporting foot marker includes a laterally-positioning segment, a first marking portion and a second marking portion; said laterally-positioning segment is perpendicular to the section which said initial-targeting guide line lies in during use, and said second marking portion lies at a terminal end of said laterally-positioning segment; said first marking portion is set above said laterally-positioning segment and can freely move above said laterally-positioning segment, so as to adjust a distance between said first marking portion and said second marking portion and to be used to direct a user's supporting foot to a preset landing point on the ground, forming a position relation between said supporting foot and said soccer ball.

14. A soccer training assembly, comprising a supporting foot marker and the soccer ball as claimed in claim 1, wherein said supporting foot marker includes a laterally-positioning segment, a first marking portion and a second marking portion; said second marking portion lies at a terminal end of said laterally-positioning segment; and said first marking portion is set above said laterally-positioning segment and can freely move above said laterally-positioning segment, so as to adjust a distance between said first marking portion and said second marking portion and to be used to direct a user's supporting foot to a preset landing point on the ground, forming a position relation between said supporting foot and said soccer ball.

15. The soccer training assembly according to claim 13, wherein said supporting foot marker further includes a length reference segment, and said length reference segment is connected with said laterally-positioning segment and is connected at the position of said second marking portion; the length of said length reference segment is used as a dimension reference for adjusting a distance between said first marking portion and said second marking portion.

16. The soccer training assembly according to claim 13, wherein said laterally-positioning segment is made of a soft rope material.

17. The soccer ball according to claim 1, wherein said marking area further includes a penalty kick guide mark, said penalty kick guide mark includes a first penalty kick angle point, a second penalty kick angle point, a third penalty kick angle point and a fourth penalty kick angle point, which are respectively used to guide a user to aim at the four corners of a goal at the time of taking a penalty kick.

18. The soccer ball according to claim 17, wherein an area formed by connecting said first penalty kick angle point, said second penalty kick angle point, said fourth penalty kick angle point and said third penalty kick angle point in turn indicates a scope of hitting points within a goal range aimed at by said user at the time of taking a penalty kick.

19. The soccer training assembly according to claim 14, wherein said supporting foot marker further includes a length reference segment, and said length reference segment is connected with said laterally-positioning segment and is connected at the position of said second marking portion; the length of said length reference segment is used as a dimension reference for adjusting a distance between said first marking portion and said second marking portion.

20. The soccer training assembly according to claim 14, wherein said laterally-positioning segment is made of a soft rope material.

* * * * *